US006564029B2

(12) United States Patent
Kojima et al.

(10) Patent No.: US 6,564,029 B2
(45) Date of Patent: May 13, 2003

(54) CARTRIDGE HAVING DEVELOPER SUPPLY OPENING AND IMAGE FORMING APPARATUS USABLE THEREWITH

(75) Inventors: Hisayoshi Kojima, Mishima (JP); Hironobu Isobe, Numazu (JP); Kenji Matsuda, Numazu (JP); Takashi Yahagi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/942,575

(22) Filed: Aug. 31, 2001

(65) Prior Publication Data

US 2002/0034404 A1 Mar. 21, 2002

(30) Foreign Application Priority Data

Sep. 1, 2000 (JP) ..... 2000-266022
Jan. 25, 2001 (JP) ..... 2001-016922

(51) Int. Cl.[7] ..... G03G 15/00; G03G 15/08
(52) U.S. Cl. ..... 399/258; 399/106; 399/120
(58) Field of Search ..... 399/258, 119, 399/120, 113, 114, 110, 111, 106

(56) References Cited

U.S. PATENT DOCUMENTS

| | | | | |
|---|---|---|---|---|
| 5,235,383 A | | 8/1993 | Tada et al. | 399/112 |
| 5,249,026 A | | 9/1993 | Kojima | 399/112 |
| 5,294,963 A | * | 3/1994 | Nakano et al. | 399/106 |
| 5,331,373 A | | 7/1994 | Nomura et al. | 399/111 |
| 5,442,421 A | | 8/1995 | Kojima | 399/112 |
| 5,452,056 A | | 9/1995 | Nomura et al. | 399/111 |
| 5,471,284 A | | 11/1995 | Fujii et al. | 399/12 |
| 5,497,220 A | | 3/1996 | Inomata et al. | 399/120 |
| 5,521,693 A | | 5/1996 | Kojima et al. | 399/228 |
| 5,528,341 A | | 6/1996 | Shishido et al. | 399/109 |
| 5,585,889 A | | 12/1996 | Shishido et al. | 399/113 |
| 5,642,187 A | | 6/1997 | Nomura et al. | 399/111 |
| 5,650,841 A | | 7/1997 | Matsuda et al. | 399/111 |
| 5,678,139 A | | 10/1997 | Nomura et al. | 399/114 |
| 5,697,022 A | | 12/1997 | Matsuda et al. | 399/102 |
| 5,825,472 A | | 10/1998 | Araki et al. | 399/111 |
| 5,842,093 A | * | 11/1998 | Tanda | 399/120 |
| 5,940,657 A | | 8/1999 | Yokomori et al. | 399/119 |
| 5,950,049 A | | 9/1999 | Yokomori et al. | 399/119 |
| 5,963,759 A | | 10/1999 | Kojima et al. | 399/111 |
| 6,016,408 A | | 1/2000 | Hashimoto et al. | 399/27 |
| 6,064,843 A | | 5/2000 | Isobe et al. | 399/111 |
| 6,072,969 A | | 6/2000 | Yokomori et al. | 399/119 |
| 6,101,352 A | | 8/2000 | Hashimoto et al. | 399/119 |
| 6,131,011 A | | 10/2000 | Kojima et al. | 399/351 |
| 6,151,459 A | | 11/2000 | Hashimoto et al. | 399/27 |
| 6,157,792 A | | 12/2000 | Mori et al. | 399/24 |
| 6,266,503 B1 | | 7/2001 | Murayama et al. | 399/117 |
| 6,289,189 B1 | | 9/2001 | Numagami et al. | 399/111 |
| 6,314,266 B1 | | 11/2001 | Murayama et al. | 399/353 |
| 6,324,370 B1 | | 11/2001 | Isobe et al. | 399/258 |
| 6,332,065 B1 | * | 12/2001 | Howard | 399/258 |

FOREIGN PATENT DOCUMENTS

| | | |
|---|---|---|
| EP | 1 103 865 | 5/2001 |
| JP | 2001-222160 | 8/2001 |

* cited by examiner

*Primary Examiner*—Sophia S. Chen
(74) *Attorney, Agent, or Firm*—Fitzpatrick, Cella, Harper & Scinto

(57) ABSTRACT

A unit detachably mountable to an image forming apparatus includes a developer accommodating portion having a developer inlet hole; a first opening and closing member for opening and closing the inlet hole; and a second opening and closing member for opening and closing the inlet hole, the second opening and closing member being movable above the first opening and closing member.

14 Claims, 32 Drawing Sheets

CARTRIDGE HAVING DEVELOPER SUPPLY OPENING AND IMAGE FORMING APPARATUS USABLE THEREWITH

FIELD OF THE INVENTION AND RELATED ART

The present invention relates to a cartridge having a developer supply opening or an inlet hole detachably mountable to an image forming apparatus, such as a copying machine or a printer using an electrophotographic recording process or an electrostatic recording process or the like, and an image forming apparatus to which the cartridge is detachably mountable.

Recently, many copying machines and printers employ a so-called cartridge-type process making the maintenance operation easy.

For example, in the case of a printer using an electrophotographic recording technique, a photosensitive member and a developing device are contained as a unit in the cartridge, which is detachably mountable to the main assembly of the printer; or the photosensitive member and a cleaning device are contained as a unit in a cartridge in which a developing device constitutes another cartridge, which is detachably mountable to the main assembly of the printer. There are various types of cartridges.

Among them, there is a type in which the developing device and the developer supply container are separate so that the developer supply container can be independently exchangeable, thus permitting the developer, which is a consumable material, to be replenished. With this type of device, it is not necessary to exchange the constituent-element in the developing device, such as a developing roller, which has a relatively long service life, at each replenishment, and therefore, this type of device is preferable from the economic standpoint, and in addition, since the size of the cartridge may be small, the cartridge can be relatively easily exchanged.

However, when the cartridge is taken out of the main assembly of the printer, care should be taken to prevent the user's hand from being contaminated.

Japanese Patent Application 11-337265 proposes that a toner discharge opening or an outlet hole of the toner cartridge and a toner receiving port of the process cartridge are brought into communication with each other in interrelation with mounting of the toner cartridge and the process cartridge to the main assembly of the image forming apparatus. As shown in FIG. 33, the toner outlet hole 23 of the toner cartridge is provided with a T shutter 27 having a substantially round configuration. A shutter cover 19, which is provided in the process cartridge, is provided with projections 19*b*, 19*c*. By doing so, when the toner cartridge and the process cartridge are mounted to or demounted from the main assembly of the image forming apparatus, the toner outlet hole 23 of the toner cartridge is closed by the T shutter 27 assuredly. More particularly, when the toner cartridge is inserted in the direction of arrow C into the main assembly of the image forming apparatus, the T shutter 27 (chain line) disposed in the bottom portion 26 of the container of the toner cartridge, is moved into the state indicated by a solid line in the direction of the arrow D by rotation about a shaft 28*a* while a projection 19*b* of the process cartridge is in engagement with a groove portion 27*b*. Thus, the toner outlet hole 23 is opened. FIG. 34 shows the behavior of rotation of the T shutter 27. When it is moved in the direction of arrow C, the T shutter 27 rotates so that opening 27*a* also moves.

On the other hand, a P shutter 18' (chain line) that closes the receiving port 16 of the process cartridge, when the process cartridge is inserted into the main assembly of the image forming apparatus (in the direction of arrow A), a groove portion 18'*z* and a projection 36 provided in the image forming apparatus are engaged and rotated in the direction indicated by an arrow B, so that P shutter 18 takes the position indicated by the solid line, thus opening the receiving port 16.

On the other hand, when the toner cartridge is demounted from the main assembly of the image forming apparatus, the T shutter 27 rotates in the direction of arrow D about the shaft 28*a* with the engagement between the projection 19*c* of the process cartridge and the groove portion 27*b*, thus closing the toner outlet hole 23. In the demounting operation of the process cartridge, the operations are reverse.

With this technique disclosed in Japanese Patent Application 11-337265, the shutter of the toner outlet hole of the toner cartridge can be closed from the demounting operation of the process cartridge or the toner cartridge. Even if the toner cartridge and the process cartridge are independently demounted from the main assembly of the image forming apparatus, the toner outlet hole can be opened and closed. In addition, the operations are assured because the opening and closing operations are carried out without use of urging means such as a spring, but are carried out by the demounting operation of the cartridge.

However, since the shutter of the toner cartridge rotates while being displaced, the track of the opening is elongated in the mounting-and-demounting direction (the direction indicated by the arrow C in FIG. 33), with the result of a higher possibility of toner leakage and scattering.

SUMMARY OF THE INVENTION

Accordingly, it is a principal object of the present invention to provide a cartridge and an image forming apparatus to which the cartridge is detachably mountable, in which the possibility of contamination of the user's hands is lessened.

It is another object of the present invention to provide a cartridge having a proper size of a developer inlet hole and an image forming apparatus to which the cartridge is detachably mountable.

It is a further object of the present invention to provide a cartridge and an image forming apparatus to which the cartridge is detachably mountable, in which the cartridge is provided with a developer inlet hole suitable to the size of the developer outlet hole of the developer supply container.

According to an aspect of the present invention, there is provided a unit detachably mountable to an image forming apparatus, including a developer accommodating portion having a developer inlet hole; a first opening and closing member for opening and closing the inlet hole; and a second opening and closing member for opening and closing the inlet hole, the second opening and closing member being movable above the first opening and closing member.

According to another aspect of the present invention, there is provided an image forming apparatus comprising a unit detachably mountable to a main assembly of the apparatus, the unit including a developer accommodating portion having a developer inlet hole and a first opening and closing member for opening and closing the inlet hole, and a second opening and closing member, movable above the first opening and closing member, for opening and closing the inlet hole; and an engaging portion for being contacted by a predetermined portion of the unit when the unit is mounted to the main assembly of the apparatus, wherein the opening and closing member is moved by the contact of the predetermined portion to the engaging portion.

According to a further aspect of the present invention, there is provided a unit detachably mountable to an image forming apparatus, comprising a developer accommodating portion having a developer inlet hole; an opening and closing member for opening and closing the inlet hole; wherein the inlet hole has a substantially parallelogram shape having an inner angle that is not a right angle.

According to a further aspect of the present invention, there is provided an image forming apparatus comprising: a unit detachably mountable to a main assembly of the apparatus, the unit including a developer accommodating portion having an opening and closing member for opening and closing the inlet hole; and an engaging portion for being contacted by a predetermined portion of the unit when the unit is mounted to the main assembly of the apparatus, wherein the opening and closing member is moved by the contact of the predetermined portion to the engaging portion; wherein the inlet hole has a substantially parallelogram shape having an inner angle which is not a right angle.

According to a further aspect of the present invention, there is provided an image forming apparatus comprising: a first unit detachably mountable to a main assembly of the operators, the first unit including a developer outlet hole and a movable shutter having a hole capable of exposing the outlet hole; a second unit detachably mountable to the main assembly of the apparatus, the second unit having a developer inlet hole for permitting passage of the developer falling from the outlet hole; wherein the shutter is movable in response to a relative motion between the first unit and the second unit; wherein a configuration of the inlet hole is along a track of an overlapped portion of the outlet hole and the hole which changes with mounting or demounting operation of the first or second unit.

These and other objects, features and advantages of the present invention will become more apparent upon a consideration of the following description of the preferred embodiments of the present invention taken in conjunction with the accompanying drawings.

THE PREFERRED EMBODIMENTS OF THE INVENTION

Hereinafter, the present invention will be described with reference to an electrophotographic color image forming apparatus. In the following description of the present invention, the lengthwise direction is the direction parallel to the axial direction of an electrophotographic photoconductive member (which hereinafter will be referred to as photoconductive drum 2). Further, with respect to the direction in which a cartridge is inserted into an electrophotographic image forming apparatus, the leading end will be referred to as the rear side, and with respect to the direction in which the cartridge is pulled out of the apparatus, the leading end will be referred to as the front side. Further, the top and bottom sides of a cartridge are the top and bottom sides of the cartridge when the cartridge is in the proper position in the apparatus main assembly.

General Description of Image Forming Apparatus

Figure 1:
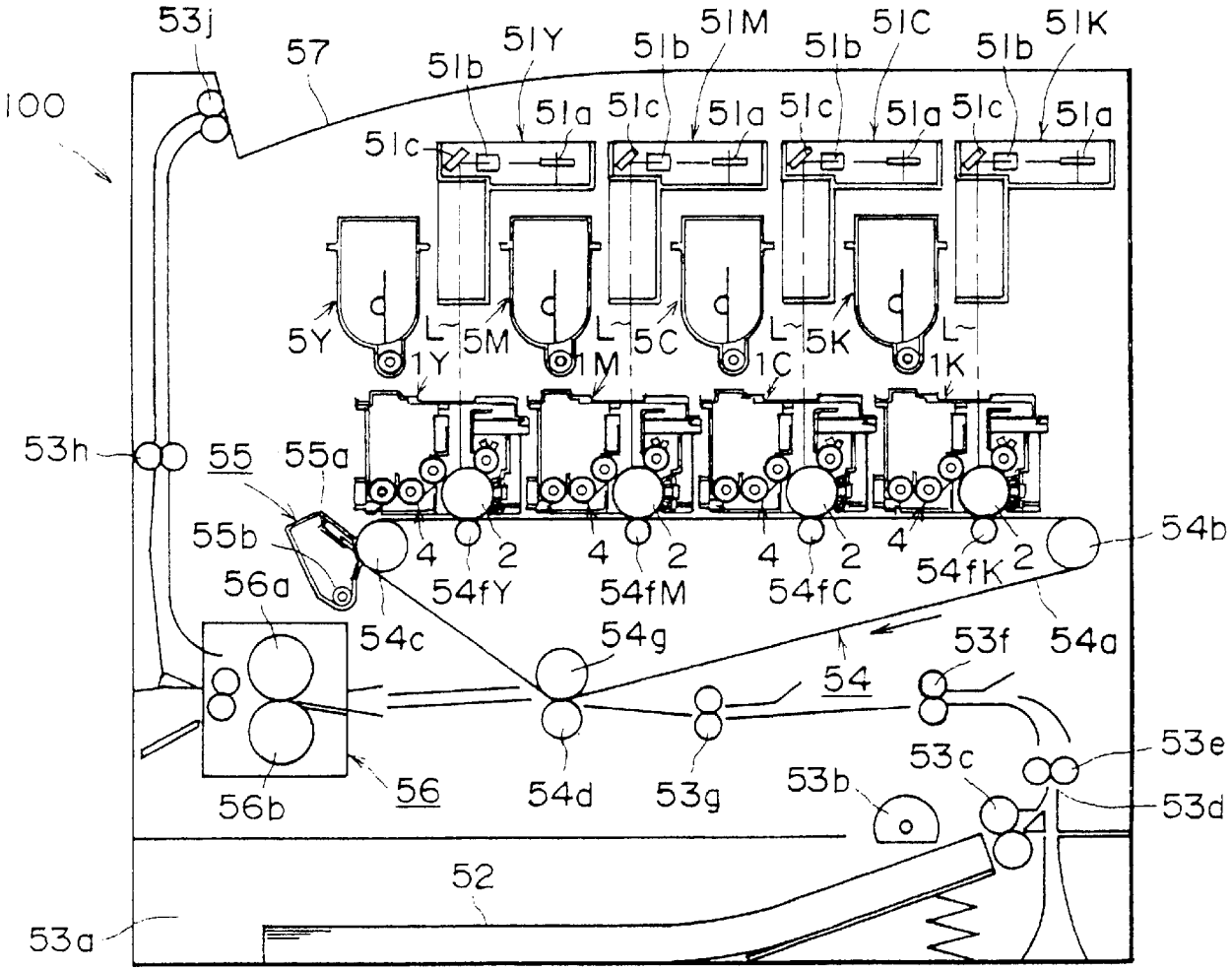
FIG. 1 is a longitudinal sectional view of a main assembly of a color electrophotographic image forming apparatus according to an embodiment of the present invention.

First, referring to FIG. 1, the general structure of an electrophotographic color image forming apparatus will be described. FIG. 1 is a drawing for depicting the general structure of a color laser beam printer, which is a form of an electrophotographic color image forming apparatus.

The image forming station of this color laser beam printer has four process cartridges 1Y, 1M, 1C, and 1K (yellow, magenta, cyan, and black colors), each of which has a photoconductive drum as an image bearing member. The image forming apparatus also has four exposing means 51Y, 51M, 51C, and 51K (laser beam based optical scanning systems), which are disposed above the process cartridges 1Y, 1M, 1C, and 1K, corresponding one for one to the preceding process cartridges identical in alphabetical reference codes.

Further, the image forming apparatus has a sheet feeding station for feeding a recording medium 52 into the main assembly of the image forming apparatus, an intermediary transfer belt 54*a* for transferring a toner image formed on the photoconductive drum 2, and a secondary transfer roller 54*d* for transferring a toner image on the intermediary transfer belt 54*a* onto the recording medium 52. The sheet feeding station, the intermediary transfer belt 54*a*, and the secondary transfer roller 54*d* are below the aforementioned image forming station.

Further, the color laser beam printer has a fixing means for fixing a toner image having been transferred onto the recording medium 52, and a discharging means for discharging the recording medium 52 from the apparatus main assembly and placing the recording media 52 in layers. The recording medium 52 is a sheet of paper, an OHP sheet, fabric, or the like.

The image forming apparatus in this embodiment is a cleaner-less apparatus. In other words, a cleaner dedicated for recovering and storing the transfer residual toner particles, that is, the toner particles which remain on the peripheral surface of the photoconductive drum 2, is not provided in a process cartridge, and the transfer residual toner particles are taken into the developing means.

Next, the structures of the various components of the above described image forming apparatus will be described in detail in the obvious order.

Sheet Feeding Station

The sheet feeding station is a station for delivering the recording medium 52 to the image forming station. Essentially, it comprises: a sheet feeder cassette 53*a* in which a plurality of recording media 52 are stored in layers: a sheet feeding roller 53*b*; a retarding roller pair 53*c* for preventing two or more recording media 52 from being delivered together; a sheet guide 53*d*; and a registration roller pair 53*g*.

The sheet feeding roller 53*b* is rotationally driven in synchronism with an image forming operation to feed the recording medium 52 one by one into the main assembly from the sheet feeding cassette 53*a* while separating the recording medium 52 at the top from the rest of the recording media 52 in the cassette 53*a*. Each recording medium 52 is prevented by the retarding roller pair 53*c*, from being conveyed together with the other recording medium 52 or media 52. After being fed into the apparatus main assembly, the recording medium 52 is conveyed to the registration roller pair 53*g* by conveying roller pairs 53*e* and 53*f* while being guided by the sheet guide 53*d*.

During an image forming operation, the registration roller pair 53*g* carries out a predetermined sequence, which comprises two distinctive processes: a process in which the registration roller pair 53*g* is kept stationary to keep the recording medium 52 on standby, and a process in which the registration roller pair 53*g* is rotated to convey the recording medium 52 toward the intermediary transfer belt 54*a*. The registration roller pair 53*g* carries out this sequence so that a toner image and the recording medium 52 become aligned with each other for a transfer process, that is, the process which follows the toner image forming process.

Immediately after the conveyance of the recording medium 52, the registration roller pair 53*g* is not rotating. If the recording medium 52 is delivered askew to the registration roller pair 53*g*, it is straightened as it bumps into the nip of the registration roller pair 53*g*.

Process Cartridge

A process cartridge is a cartridge, which is removably mountable in the main assembly of an electrophotographic image forming apparatus, and in which a charging means, a developing means or a cleaning means, and an electrophotographic photoconductive drum, are integrally disposed. It also includes: a cartridge, which is removably mountable in the main assembly of an electrophotographic image forming apparatus, and in which at least one means among a charging means, a developing means, and a cleaning means, and an electrophotographic photoconductive drum, are integrally disposed; and a cartridge, which is removably mountable in the main assembly of an electrophotographic image forming apparatus, and in which at least a developing means, and an electrophotographic photoconductive drum, are integrally disposed. In this embodiment, the main assembly 100 of an image forming apparatus employs a cleaner-less system, which will be described later. Therefore, the process cartridge in this embodiment is such a cartridge in which a charging means, a developing means, and an electrophotographic photoconductive drum are integrally disposed, and which is removably mountable in the apparatus main assembly 100.

In each of the process cartridges 1Y, 1M, 1C, and 1K, a charging means and a developing means, and the photoconductive drum 2 are integrally disposed in such a manner that the charging means and developing means surround the peripheral surface of the photoconductive drum 2, that is, an image bearing member. This process cartridge 1 is enabled to be easily removed from the main assembly (which hereinafter will be referred to as apparatus main assembly 100) of an electrophotographic image forming apparatus by a user, so that it can be replaced as the service life of the photoconductive drum 2 expires. In this embodiment, whether or not the service life of the process cartridge 1 has expired is determined by counting the number of the rotations of the photoconductive drum 2 or a charging time period, and a user is informed of the expiration of the service life of the photoconductive drum 2 as the count exceeds a predetermined level.

The photoconductive drum 2 in this embodiment is an organic photoconductive member which is negatively charged. It comprises a base member, a photoconductive layer, and a charge injection layer. The base member is a cylindrical, hollow aluminum drum 2*h*, which is approximately 30 mm in diameter. The photoconductive layer is an ordinary photoconductive layer coated on the peripheral surface of the aluminum base drum 2*h*. The charge injection layer is the outermost layer. The photoconductive drum 2 is rotationally driven at a predetermined process speed, which is approximately 117 mm/sec in this embodiment.

The charge injection layer is a coated layer of dielectric resin (binder) in which electrically conductive microscopic particles, for example, SnOSUB-2/SUB, have been dispersed.

Figure 4:
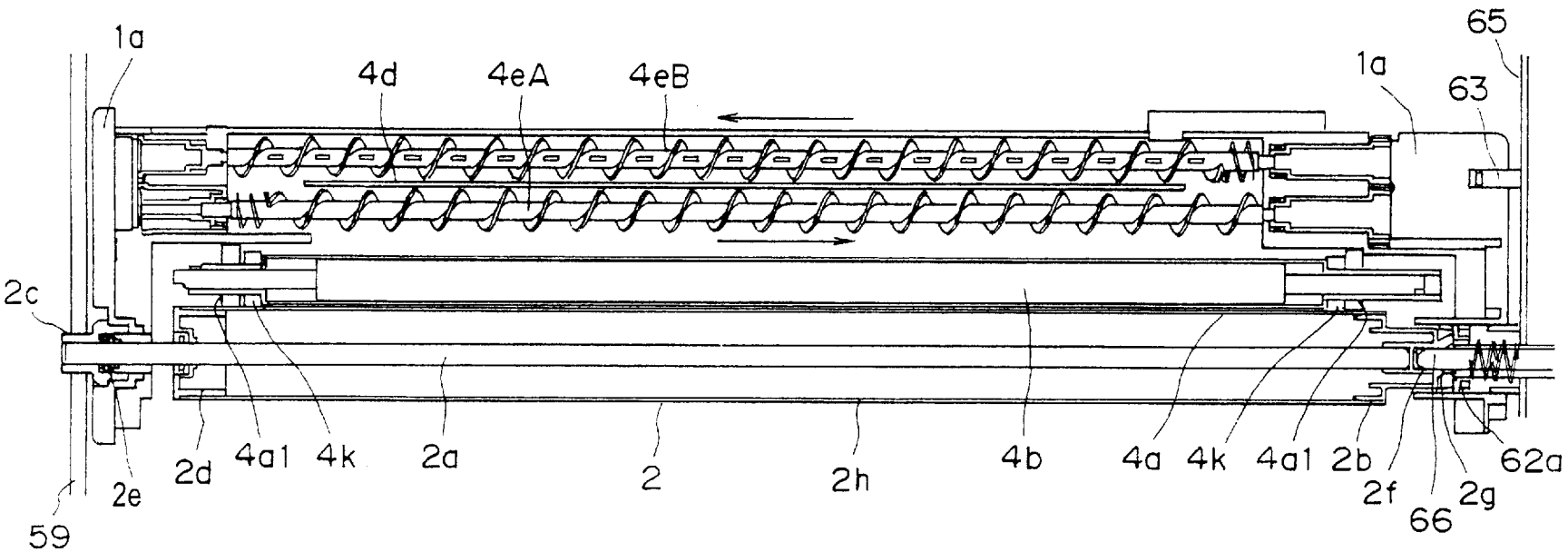
FIG. 4 is a cross-sectional view of a process cartridge (longitudinal section of the process cartridge) according to an embodiment of the present invention.

Referring to FIG. 4, the photoconductive drum 2 is provided with a drum flange 2*b* and a nondriven flange 2*d*. The drum flange 2*b* is fixed to the rear end (right-hand end in FIG. 4) of the base drum 2*h* of the photoconductive drum 2 in terms of the lengthwise direction of the photoconductive drum 2, and a non-driven flange 2*d* is fixed to the front end (left-hand end in FIG. 4). The photoconductive drum 2 also has a drum shaft 2*a*, which is put through the centers of the drum flange 2*b* and non-driven flange 2*d*. The drum shaft 2*a* and flange 2*d* are solidly fixed to each other. The base drum 2*h*, the drum shaft 2*a*, the drum flange 2*b*, and the drum flange 2*d*, are rotated together. In other words, the photoconductive drum 2 is rotated about the axial line of the drum shaft 2*a*.

The front end of the drum shaft 2*a* is rotationally supported by a bearing 2*e*, which is fixed to a bearing case 2*c*. The bearing case 2*c* is fixed to the frame 1*a* of the process cartridge 1.

Charging Means

Figure 2:
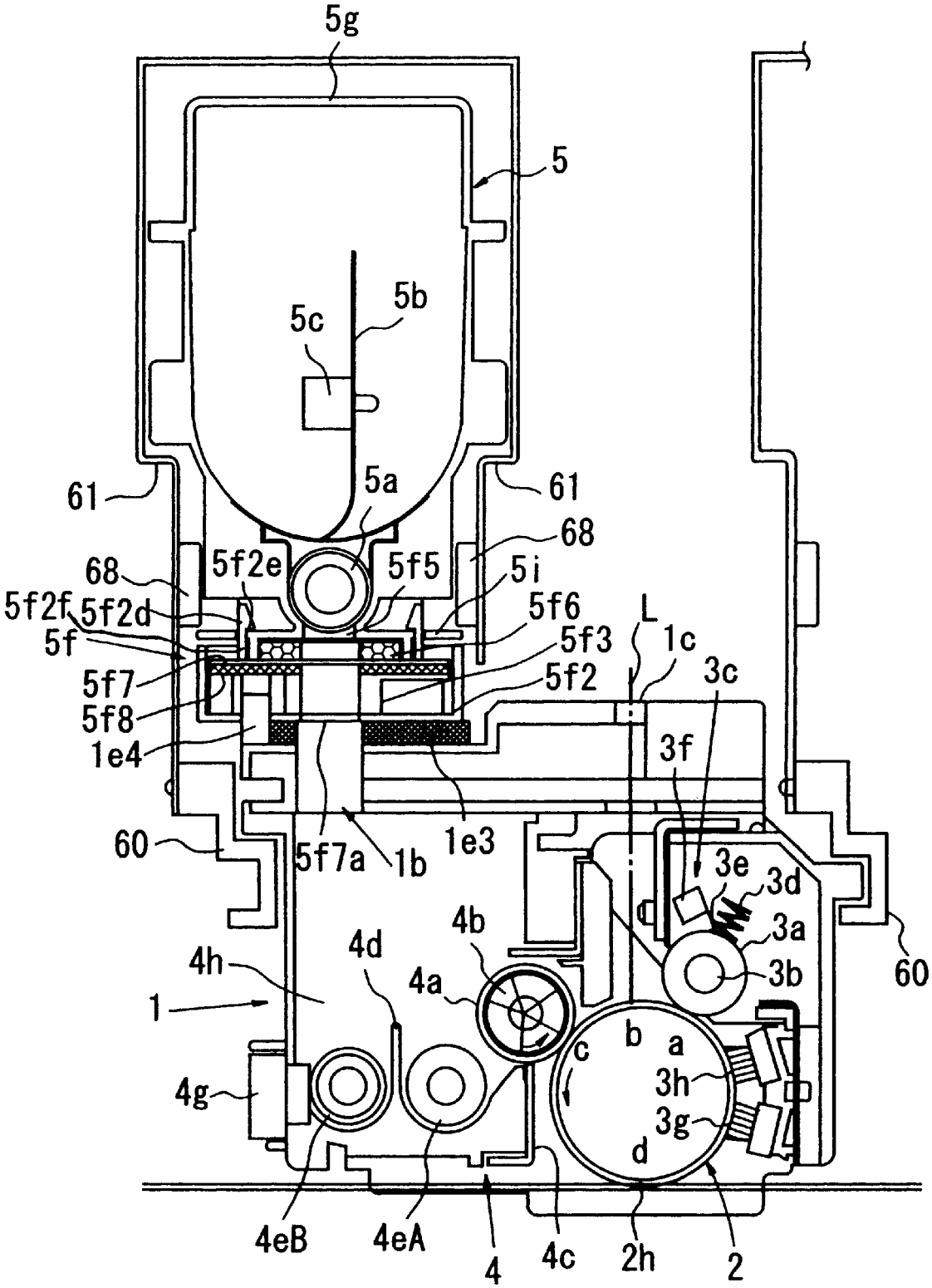
FIG. 2 is longitudinal sectional view of a process cartridge and a toner supply container according to an embodiment of the present invention.

Referring to FIG. 2, the charging means in this embodiment is such a charging means that employs a contact charging method. It employs a charge roller 3*a* as a charging member. The charge roller 3*a* is rotationally supported by unshown bearings, which support the lengthwise ends of the metallic core 3*b* of the charging roller 3*a*. It is kept under a predetermined amount of pressure generated by a pair of coil springs 3*d* in the direction of the photoconductive drum 2 so that the peripheral surface of the charge roller 3*a* is kept pressed upon the peripheral surface of the photoconductive drum 2. It rotates following the rotation of the photoconductive drum 2.

A reference code 3*c* designates a charge roller cleaning member, which comprises a supporting member 3*f*, and a flexible cleaning film 3*e* attached to the supporting member 3*f*. This cleaning film 3*e* is rectangular and is disposed in a manner to extend parallel to the lengthwise direction of the charge roller 3*a*. It is fixed, by one of its long edges, to the supporting member 3*f* so that its surface adjacent to the other long edge, or the free long edge, forms a contact nip against the peripheral surface of the charge roller 3*a*. The supporting member 3*f* is enabled to reciprocally move a predetermined distance in a direction parallel to its lengthwise direction. As the supporting member 3*f* is driven by an unshown driving means in a manner to reciprocally move a predetermined distance in its lengthwise direction, the peripheral surface of the charge roller 3*a* is rubbed by the cleaning film 3*e*. As a result, the foreign substances (microscopic toner particles, additives, and the like) that have adhered to the peripheral surface of the charge roller 3*a* are removed.

The image forming apparatus in this embodiment employs a cleaner-less cleaning system. Next, this cleaner-less cleaning system will be described.

Cleaner-less Cleaning System

Referring to FIG. 2, the gist of the cleaner-less cleaning system of the image forming apparatus in this embodiment will be described. This cleaner-less cleaning system is such a cleaning system that removes the transfer residual toner particles on the photoconductive drum 2 by the developing means at the same time as the photoconductive drum 2 is charged by the developing means. More specifically, after the image transfer, the transfer residual toner particles on the photoconductive drum 2 are carried to a development station c, past the charge station a and an exposure station b, by the subsequent rotation of the photoconductive drum 2, and are removed by the developing means as the photoconductive drum 2 is charged by the developing to means in the development station c.

Since the transfer residual toner particles on the peripheral surface of the photoconductive drum 2 pass through the exposure station b, the exposing process is carried out with the presence of the transfer residual toner particles on the peripheral surface of the photoconductive drum 2. But, the amount of the transfer residual toner particles on the peripheral surface of the photoconductive drum 2 is not large enough to significantly affect the exposing process. However, the transfer residual toner is a mixture of positively charged toner particles and negatively (reversely) charged toner particles. Further, some of the transfer residual toner particles are smaller in the amount of charge than the others. Thus, it is possible that as the reversely charged transfer residual toner particles and/or insufficiently charged transfer residual toner particles, on the peripheral surface of the photoconductive drum 2, pass through the charge station a, they adhere to the charge roller 3*a*. If the charge roller 3*a* is contaminated beyond a certain level by the adhesion of the transfer residual toner particles, the charge roller 3*a* fails to properly charge the photoconductive drum 2. Further, in order to improve the efficiency with which the transfer residual toner particles on the peripheral surface of the photoconductive drum 2 are removed by the developing apparatus at the same time as the photoconductive drum 2 is charged by the developing apparatus, it is necessary that the transfer residual toner particles on the photoconductive drum 2, which are carried to the development station c, are positive in polarity, and the amount of the charge of each transfer residual toner particle is proper for the developing apparatus to develop the electrostatic latent image on the photoconductive drum 2. The reversely charged toner particles, and the toner particles which are not proper in the amount of charge, cannot be removed or recovered from the photoconductive drum 2 by the developing apparatus, which results in the formation of a low quality image.

In recent years, user needs have diversified. For example, the user need for printing such an image as a photographic image that requires an image forming apparatus to be continually operated at a high printing ratio has begun to increase. Thus, with the diversification of user needs, the above-described problem has begun to widely manifest itself, since the continual operation of an image forming apparatus at a high printing ratio produces a large amount of transfer residual toner all at once.

Thus, in order to evenly disperse the transfer residual toner particles on the peripheral surface of the photoconductive drum 2, across the peripheral surface of the photoconductive drum 2, the image forming apparatus in this embodiment is provided with a transfer residual toner particle dispersing means 3*g*, which is disposed in the adjacencies of the peripheral surface of the photoconductive drum 2, on the downstream side of the transfer station d in terms of the rotational direction of the photoconductive drum 2. Further, the image forming apparatus is provided with a toner charge controlling means 3*h* for unifying in polarity the transfer residual toner (developer) particles. The toner charge controlling means 3*h* is disposed in the adjacencies of the peripheral surface of the photoconductive drum 2, on the downstream side of the transfer residual toner particle dispersing means 3*g* and on the upstream side of the charge station a, in terms of the rotational direction of the photoconductive drum 2. The toner charge controlling means 3*h* rectifies the polarities of the reversely charged transfer residual toner particles to the negative polarity, or the normal polarity.

With the provision of the transfer residual toner dispersing means 3*g*, the transfer residual toner particles, which have been dispersed in a certain pattern and are carried from the transfer station d to the toner charge controlling means 3*h*, are evenly dispersed across the peripheral surface of the photoconductive drum 2 even if the amount of the transfer residual toner particles is large. In other words, the transfer residual toner particles, which have been distributed in a certain pattern on the peripheral surface of the photoconductive drum 2, are evenly dispersed across the peripheral surface of the photoconductive drum 2, being therefore prevented from being concentrated to certain portions of the toner charge controlling means 3*h*, assuring that all the transfer residual toner particles are unified in polarity, being charged to the normal polarity. Therefore, the efficiency with which the transfer residual toner particles are prevented from adhering to the charge roller 3*a* is improved. Consequently, the formation of a ghost image, that is, the ghostly pattern in a completed image, for which the transfer residual toner particles are responsible, is prevented.

In this embodiment, the transfer residual toner particle dispersing means 3*g* and toner charge controlling means 3*h* are given a proper amount of electrical conductivity, and are in the form of a brush. They are disposed so that their actual brush portions remain in contact with the peripheral surface of the photoconductive drum 2.

These means are enabled to be moved (reciprocated) by an unshown driving power source in the lengthwise direction of the photoconductive drum 2 so that the transfer residual toner particle dispersing means 3*g* and toner polarity controlling means 3*h* are prevented from remaining at the same positions relative to the peripheral surface of the photoconductive drum 2. Thus, even if the toner charge controlling means 3*h* is not uniform in electrical resistance, and therefore, has portions with excessive charging capacity and portions with insufficient charging capacity, these portions do not remain at the same positions relative to the peripheral surface of the photoconductive drum 2. Consequently, the possibility that a microscopic amount of the transfer residual toner particles will be fused to certain portions of the peripheral surface of the photoconductive drum 2 by being overcharged, or remains adhered to certain portions of the peripheral surface of the charge roller 3*a* by being undercharged, is eliminated or reduced.

Exposing Means

In this embodiment, the photoconductive drum 2 is exposed with the use of a laser based exposing means. More specifically, image signals are sent to the exposing means from the image forming apparatus main assembly 100. As the signals are sent to the exposing means, a laser beam L modulated with the image signals is projected in a manner to uniformly scan the uniformly charged peripheral surface of the photoconductive drum 2. As a result, the uniformly charged peripheral surface of the photoconductive drum 2 is selectively exposed. Consequently, an electrostatic latent image in accordance with the image formation data is formed on the peripheral surface of the photoconductive drum 2.

Referring to FIG. 1, the laser based exposing means comprises a solid state laser element (unshown), a polygon mirror 51*a*, a focusing lens 51*b*, a reflection mirror 51*c*, and the like. The solid state laser element is turned on and off by a light emitting signal generating device (unshown) in response to the inputted image signals. The laser beam L emitted from the solid state laser element is converted by a collimator lens system (unshown) into a flux of virtually parallel light, is deflected in a manner to make a scanning movement, by the polygon mirror 51*a* which is being rotated at a high speed, and is focused in the form of a spot on the peripheral surface of the photoconductive drum 2 by way of the focusing lens 51*b* and the deflection mirror 51*c*.

Since the photoconductive drum 2 is rotated while its peripheral surface is exposed to the scanning laser beam L, not only is the peripheral surface of the photoconductive drum 2 scanned by the laser beam L in the primary direction, or the moving direction of the laser beam L, but it also is scanned in the secondary direction, or the rotational direction of the photoconductive drum 2. As a result, the peripheral surface of the photoconductive drum 2 is exposed in a manner to reflect the sequential image signals. In other words, the uniformly charged peripheral surface of the photoconductive drum 2 is divided into light potential portions, that is, the portions, the surface potential of which has been reduced by the exposure to the laser beam L, and dark potential portions, that is, the portions, the surface potential of which has not been reduced by the laser beam L. Consequently, an electrostatic latent image in accordance with the image formation data emerges due to the contrast between the light potential portions and dark potential portions.

Developing Apparatus

The developing apparatus 4 in this embodiment is a contact type developing apparatus which uses two component developer (two component magnetic brush type developing apparatus). Referring to FIG. 2, it comprises a development sleeve 4*a* as a developer bearing member, a magnetic roller 4*b* disposed in the hollow of the development sleeve 4*a*, and developer, that is, a mixture of carrier and toner, which is borne on the peripheral surface of the development sleeve 4*a*. This development sleeve 4*a* constitutes the developing means. The developing apparatus 4 is also provided with a regulating blade 4*c*, which is disposed a predetermined gap away from the peripheral surface of the development sleeve 4*a* so that as the development sleeve 4*a* is rotated in the direction of an arrow mark, a thin layer of the developer is formed on the peripheral surface of the development sleeve 4*a*. Incidentally, even though a two component magnetic brush type developing apparatus is employed as the developing apparatus 4 in this embodiment, the developing-apparatus choice is not limited to this type of developing apparatus.

Referring to FIG. 4, the development sleeve 4*a* has a pair of journal portions 4*a*1, which are located at the lengthwise ends of the development sleeve 4*a* one for one. The smaller diameter portion of each journal portion 4*a*1 is fitted with a rotational spacer ring 4*k* in the form of a hollow roller so that a predetermined gap is maintained between the peripheral surfaces of the development sleeve 4*a* and the photoconductive drum 2 to allow the layer of developer formed on the peripheral surface of the development sleeve 4*a* to make contact with the peripheral surface of the photoconductive drum 2 to develop the latent image on the peripheral surface of the photoconductive drum 2. Referring to FIG. 2, the development sleeve 4*a* is rotationally driven at a predetermined peripheral velocity in the counterclockwise direction indicated by an arrow mark so that the moving direction of the peripheral surface of the development sleeve 4*a* in the development station becomes counter to the moving direction of the peripheral surface of the photoconductive drum 2 in the development station.

The toner employed in this embodiment is 6 Jm in average particle diameter, and is negatively charged. The magnetic carrier employed in this embodiment is 35 Jm in average particle diameter and is 205 emu/cmSUP3/SUP in saturation magnetization. The toner and carrier are mixed at a weight ratio of 6:94 to be used as the developer. Developer choice does not need to be limited to a mixture of toner and magnetic carrier. For example, magnetic toner may be employed.

Referring to FIG. 2, a developer holding portion 4*h*, in which the developer is circulated, is divided by a partitioning wall 4*d* into a two chambers. The partitioning wall 4*d* extends in the lengthwise direction of the process cartridge 1 from one end of the developer holding portion 4*h* to the other except for the immediate adjacencies of the end walls of the developer holding portion 4*h*. The developer holding portion 4*h* is provided with a pair of stirring screws 4*e*A and 4*e*B, which are disposed in a manner to sandwich the partitioning wall 4*d*.

Referring to FIG. 4, as toner is supplied into the developer holding portion 4*h* from a toner supply container 5, it falls into the rear side (right side in FIG. 4) of stirring screws 4*e*B, and is sent toward the front side (left side in FIG. 4) while being stirred. As the toner reaches the front end of the toner holding portion 4*h*, it moves into the other side of the partition wall 4*d*, past the gap between the front end of the partition wall 4*d* and the front wall of the developer holding portion 4*h*. Then, it is sent by the stirring screw 4*e*A to the rear end (right side in FIG. 4). As it reaches the rear end of the developer holding portion 4*h*, it moves into the side into which it fell from the toner supply container 5, and is sent again by the stirring screw 4*e*B toward the front end to be re-circulated.

At this time, the development process for visualizing an electrostatic latent image formed on the photoconductive drum 2, with the use of the developing apparatus 4 which employs a two component magnetic brush based developing method, and the developer circulating system, will be described with reference to FIG. 2. As the development sleeve 4*a* is rotated, the developer within the developer holding portion 4*h* is picked up in a layer by the pickup pole of the magnetic roller 4*b* onto the peripheral surface of the development sleeve 4*a*, and is conveyed toward the development station.

As the layer of developer on the peripheral surface of the development sleeve 4*a* is conveyed toward the development station, its is regulated in thickness by the regulating blade 4*c* disposed in the radius direction of the development sleeve 4*a*. As a result, a thin layer of developer is formed on the peripheral surface of the development sleeve 4*a*. As this thin layer of developer is conveyed to a position in the development station, which corresponds to the development pole, the developer is made to crest like a wave by the magnetic force. The electrostatic latent image on the peripheral surface of the photoconductive drum 2 is developed by the toner within the crested portion of the thin layer of developer into a toner image. It should be noted here that in this embodiment, the electrostatic latent image is reversely developed.

As the development sleeve 4*a* is further rotated, the thin layer of developer on the peripheral surface of the development sleeve 4*a* passes the development station and enters the developer holding portion 4*h*, in which it is repelled by the repellent magnetic field of the conveyance pole, from the peripheral surface of the development sleeve 4*a*, and falls back into the developer holding portion 4*h*.

To the development sleeve 4*a*, DC and AC voltages are applied from unshown electrical power sources. More specifically, in this embodiment, a DC voltage of −500 V, and an AC voltage having a frequency of 2,000 Hz and a peak-to-peak voltage of 1,500 V, are applied to selectively develop the peripheral surface of the photoconductive drum 2; only the exposed portions of the peripheral surface of the photoconductive drum 2 are developed.

Generally speaking, in a two component magnetic brush based developing method, the application of AC voltage improves the development efficiency, and therefore, improves image quality. However, it also brings forth such an adverse possibility that a foggy image will be produced. Thus, normally, a difference in potential level is provided between the DC voltage applied to the development sleeve 4*a* and the electrical charge of the peripheral surface of the photoconductive drum 2 to prevent the formation of a foggy image. More concretely, the potential level of the bias voltage applied to the development sleeve 4*a* is set so that it falls between the surface potential levels of the exposed and unexposed portions of the photoconductive drum 2.

As the toner is consumed by development, the toner density of the developer decreases. Referring to FIG. 2, in this embodiment, a sensor 4*g* for detecting the toner density is disposed close to the peripheral surface of the stirring screw 4*e*B. As the sensor 4*g* detects that the toner density of the developer has dropped below a predetermined level, a command for supplying toner into the developer holding portion 4*h* of the developing apparatus from the toner supply container 5 is issued. The toner density of the developer is kept at a predetermined level by this toner supplying process.

Toner Supply Container

Toner supply containers 5Y, 5M, 5C,and 5K are disposed in parallel to each other, above the process cartridges 1Y, 1M, 1C, and 1K, one for one. They are mounted from the front side of the image forming apparatus main assembly 100.

Figure 5:
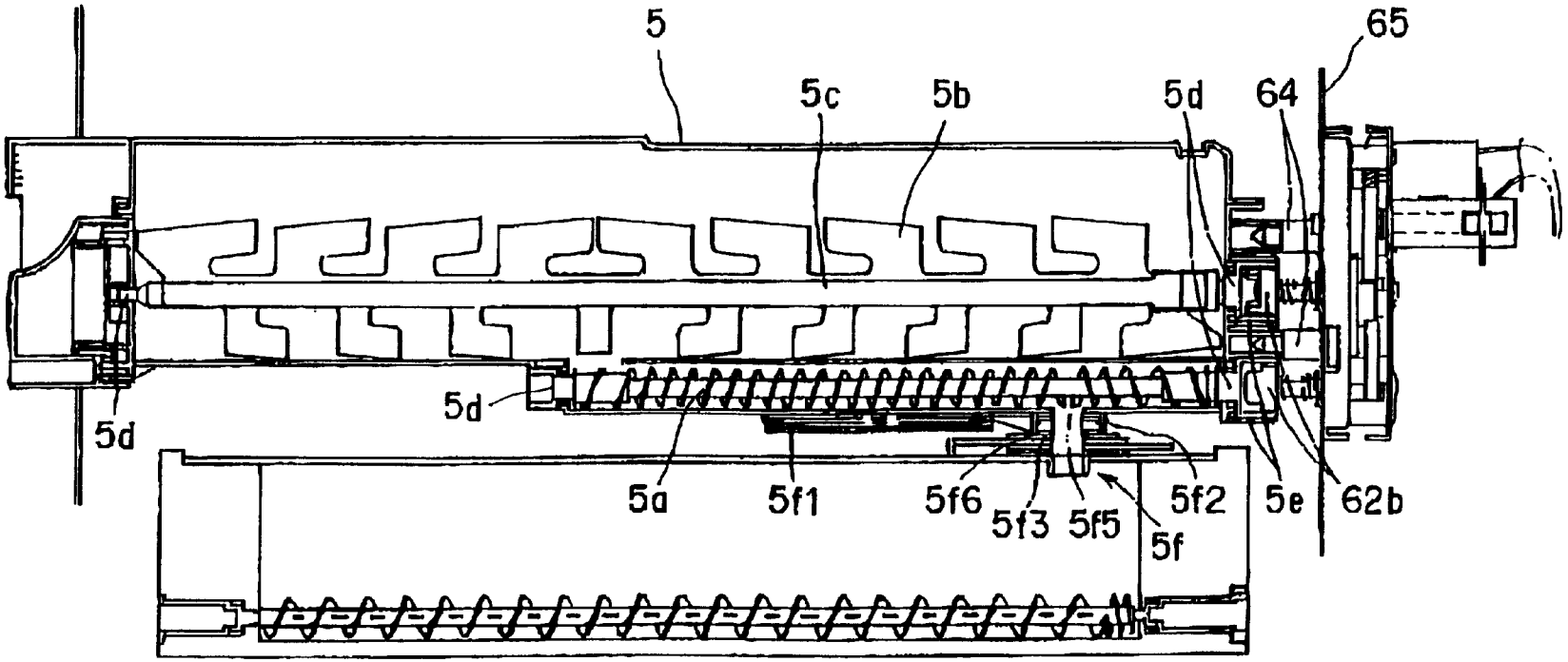
FIG. 5 is longitudinal sectional view of a toner supply container and a process cartridge according to an embodiment of the present invention.

Referring to FIG. 2, each toner supply container 5 comprises a shell 5*g* as a toner holding portion (developer holding portion), a stirring shaft 5*c*, a stirring plate 5*b*, and a screw 5*a*. Toner or a mixture of toner and magnetic carrier is stored in the shell 5*g*. The stirring plate 5*b* is fixed to the stirring shaft 5*c*. The stirring shaft 5*c*, the stirring plate 5*b* and the screw 5*a* are disposed within the shell 5*g*. The bottom wall of the toner supply container 5 is provided with a toner outlet hole 5*f* through which toner is discharged. Referring to FIG. 5, the screw 5*a* and the stirring shaft 5*c* are rotationally supported by a pair of bearings 5*d*, by their lengthwise ends. The rearmost ends of the screw 5*a* and the stirring shaft 5*c* are fitted with a driving coupling 5*e* (female type). The driving coupling 5*e* (female type) is rotationally driven as it receives a driving force from the driving coupling 62*b* (male type) on the apparatus main assembly 100 side. The peripheral portion of the screw 5*a* in terms of the radius direction of the screw 5*a* is in the form of a spiral rib, and has right and left sections, with respect to the axial line of the toner outlet hole 5*f*, which are opposite to each other in a twist direction. The screw 5*a* is rotated in a predetermined direction by the rotation of the driving coupling 62*b* (male type). As the screw 5*a* rotates, toner is conveyed toward the toner outlet portion 5*f*, and is allowed to free fall through the toner outlet hole 5*f*5 of the toner outlet portion 5*f* to supply the process cartridge 1 with toner.

The peripheral edge of the stirring plate 5*b* in terms of the rotational radius direction is angled relative to the internal surface of the wall of the shell 5*g*, so that it makes contact with, and slides on, the internal surface of the wall of the shell 5*g* at an angle. More specifically, as the peripheral portion of the stirring plate 5*b* comes into contact with the wall of the shell 5*g*, it becomes spirally twisted. Therefore, as the stirring plate 5*b* is rotated, the peripheral portion of the stirring plate 5*b* contacts the toner at an angle, generating a force that moves the toner in the axial direction of the stirring shaft 5*c*. As a result, the toner is conveyed in the lengthwise direction of the process cartridge 1.

Incidentally, the toner supply container 5 in this embodiment is capable of supplying toner to not only a process cartridge which employs a two component developing method, but also a process cartridge which employs a single component developing method. It also is capable of supplying a development cartridge with toner. The choice of the powdery substance which is to be held in the toner supply container does not need to be limited to toner. Obviously, it may be a so-called developer, that is, a mixture of toner and magnetic carrier.

Transferring Means

Referring to FIG. 1, an intermediary transfer unit 54, which is a transferring means, is a unit for transferring a toner image.

The intermediary transfer unit 54 is provided with an intermediary transfer belt 54*a*, which runs in the direction of an arrow mark. More specifically, the intermediary transfer belt 54*a* runs in the clockwise direction indicated by the arrow mark at a velocity approximately the same as the peripheral velocity of the photoconductive drum 2. This intermediary transfer belt 54*a* is an endless belt with a circumferential length of approximately 940 mm, and is suspended around three rollers: a driver roller 54*b*, a secondary transfer counter roller 54*g*, and a follower roller 54*c*.

Within the loop of intermediary transfer belt 54*a*, transfer charge rollers 54*f*Y, 54*f*M, 54*f*C, and 54*f*K are rotationally disposed, each being kept pressured upon the inward surface of the intermediary transfer belt 54*a*, at a position corresponding to the photoconductive drum 2 on the outward side of the intermediary transfer belt 54*a*, in the radius direction of the photoconductive drum 2 of the corresponding process cartridge.

The transfer charge rollers 54*f*Y, 54*f*M, 54*f*C, and 54*f*K receive electrical power from an unshown high voltage power source, and charge the intermediary transfer belt 54*a* to a polarity opposite to the toner polarity, from the inward side of the intermediary transfer belt loop, to sequentially transfer (primary transfer) the toner images on the photoconductive drums 2 onto the outward surface of the intermediary transfer belt 54*a*.

In the secondary transfer station, the secondary transfer roller 54*d* and the secondary transfer counter roller 54*g* are disposed on the inward and outward sides of the intermediary transfer belt loop. When carrying out the second transfer process, the two rollers are pressed against each other in a manner to pinch the intermediary transfer belt 54*a* between them. The secondary transfer roller 54*d* is rotational, and also is movable in the vertical direction in FIG. 1. In order to prevent the secondary transfer roller 54*d* from disturbing the toner images on the intermediary transfer belt 54*a*, the secondary transfer roller 54*d* is kept separated from the intermediary transfer belt 54*a* until a multicolor image is completed, that is, until all the monochromatic toner images are transferred in layers onto the intermediary transfer belt 54*a*.

The intermediary transfer belt 54*a* and the secondary transfer roller 54*d* are driven independently from each other. As the recording medium 52 enters the secondary transfer station, a predetermined bias is applied to the secondary transfer roller 54*d*. As a result, the multicolor toner image on the intermediary transfer belt 54*a* is transferred (secondary transfer) onto the recording medium 52.

During the above-described secondary transfer process, the recording medium 52 is conveyed leftward in FIG. 1 at a predetermined velocity, while remaining pinched by the intermediary transfer belt 54*a* and the secondary transfer roller 54*d*, to a fixing device 56 in which the next process is carried out.

At the most downstream end of the range in which the transfer process is carried out, a cleaning unit 55 is located, being enabled to be placed in contact with, or separated from, a predetermined point of the outward surface of the intermediary transfer belt 54*a* to remove the secondary transfer residual toner particles, or the toner particles remaining on the intermediary transfer belt 54*a* after the secondary transfer.

Referring to FIG. 1, a cleaning blade 55*a* for removing the secondary transfer residual toner particles is placed within a cleaning unit 55, which is rendered pivotal about an unshown pivot. The cleaning blade 55*a* is kept pressed upon the intermediary transfer belt 54*a*, being tilted against the moving direction of the intermediary transfer belt 54*a*. The secondary transfer residual toner particles are taken into the cleaning unit 55 and are conveyed by a conveying screw 55*b* to a container (unshown) for the secondary transfer residual toner particles, to be stored therein.

As for the material for the intermediary transfer belt 54*a*, polyimide resin may be used. The material selection is not limited to polyimide. For example, plastics such as polycarbonate resin, polyethylene-terephthalate resin, polyfluorovinylidene resin, polynaphthalate resin, polyether-ether-ketone resin, polyether-sulfone resin, or polyurethane resin, as well as fluorinated rubber or siliconized rubber, can also be used with preferable results, in addition to the polyimide resin.

Fixing Station

As described above, after being formed on the photoconductive drum 2 by the developing means, the toner image is transferred onto the recording medium 52 by way of the intermediary transfer belt 54*a*, and is thermally fixed to the recording medium 52 by the fixing device 56.

Referring to FIG. 1, the fixing device 56 has a fixing roller for applying heat to the recording medium 52, and a pressing roller 56*b* for pressing the recording medium 52 upon the fixing roller 56*a*. Both rollers are hollow, and contain a heater (unshown). They convey together the recording medium 52 as they are rotationally driven.

More specifically, heat and pressure are applied to the toner image and the recording medium 52 as the recording medium 52 on which the toner image is held is conveyed by the fixing roller 56*a* and the pressing roller 56*b*. As a result, the toner image is fixed to the recording medium 52. After the fixation of the toner image, the recording medium 52 is discharged by a discharge roller pair 53*h* and a discharge roller pair 53*j* from the apparatus main assembly 100, and is accumulated in a tray 57 located at the top of the apparatus main assembly 100.

Mounting of Process Cartridge and Toner Supply Container

Figure 3:
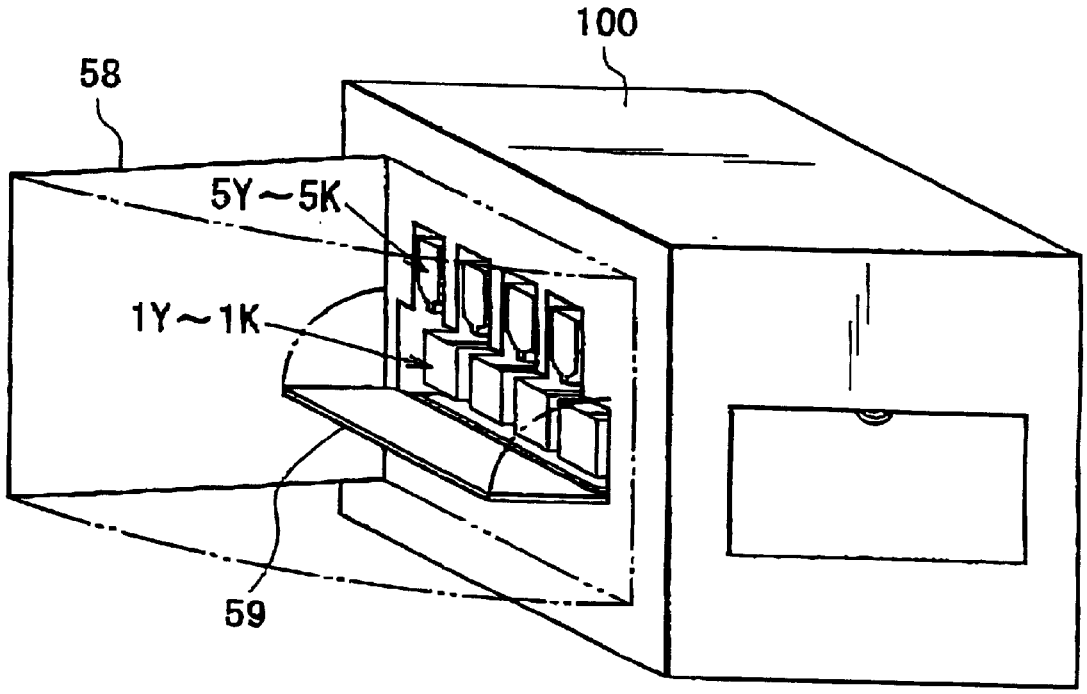
FIG. 3 is a schematic perspective view wherein a front door of an image forming apparatus is opened according to an embodiment of the present invention.

Next, referring to FIGS. 2–5, the steps through which the process cartridge 1 and the toner supply container 5 are mounted into the apparatus main assembly 100 will be described. FIG. 3 is a rough, external perspective view of the image forming apparatus main assembly 100. As shown in FIG. 3, the image forming apparatus main assembly 100 is provided with a front door 58, which is located on the front side of the apparatus main assembly 100, and can be opened or closed by a user. As the front door 58 is pulled frontward, an entrance through which the process cartridges 1Y–1K, and the toner supply containers 5Y–5K are inserted into the apparatus main assembly 100 is exposed.

The entrance through which each process cartridge 1 is inserted is provided with an aligning plate 59, which is rotationally supported. The process cartridge 1 is inserted or pulled out after this aligning plate is opened. Referring to FIG. 2, within the image forming apparatus main assembly 100, guide rails 60 for guiding the process cartridge 1 when mounting or dismounting the process cartridge 1, and guide rails 61 for guiding the toner supply container 5 when mounting or dismounting the toner supply container 5, are disposed.

The direction in which the process cartridge 1 or the toner supply container 5 are mounted into the image forming apparatus main assembly 100 is parallel to the axial line of the photoconductive drum 2. Also, the direction in which the guide rails 60 and 61 are extended is parallel to the axial line of the photoconductive drum 2. When mounting the process cartridge 1 or the toner supply container 5, it is slid into the apparatus main assembly 100, on the guide rails 60 or 61, respectively, from the front side of the apparatus main assembly 100.

Referring to FIG. 4, as the process cartridge 1 is inserted to the deepest end of the cartridge mounting space, the aligning shaft 66 of the apparatus main assembly 100 is inserted into the center hole 2*f* of the drum flange 2*b*. As a result, the position of the rotational axis of the deepest end (rear end) of the photoconductive drum 2 becomes fixed relative to the apparatus main assembly 100. At the same time, the driving force transmitting portion 2g of the drum flange 2*b* is connected with the driving coupling 62*a* (female type) of the apparatus main assembly 100, enabling the photoconductive drum 2 to be rotationally driven. The driving force transmitting portion 2*g* employed in this embodiment is in the form of a twisted triangular pillar. Thus, as it is rotated, not only does it transmit the driving force from the apparatus main assembly 100 side to the photoconductive drum 2, but also it generates such force that pulls the photoconductive drum 2 rearward of the apparatus main assembly 100.

Referring to FIG. 4, the rear plate 65 is provided with a supporting pin 63 for positioning the process cartridge 1; the position of the frame 1*a* of the process cartridge 1 relative to the apparatus main assembly 100 is fixed as the supporting pin 63 is inserted into the frame 1*a* of the process cartridge 1.

Also referring to FIG. 4, the apparatus main assembly 100 is provided with a rotatable aligning plate 59, which is located on the front side (left side in FIG. 4). Into the hole of this aligning plate 59, the bearing case 2*c* of the process cartridge 1 is inserted, so that the process cartridge 1 is supported by the apparatus main assembly 100 while being accurately positioned relative to the apparatus main assembly 100. Through the above-described insertion sequence, the photoconductive drum 2 and the process cartridge 1 are accurately positioned relative to the apparatus main assembly 100.

Referring to FIG. 5, as the toner supply container 5 is inserted to the deepest end of the toner supply container mounting space in the same manner as the process cartridge 1 is inserted to the deepest end of the process-cartridge mounting space, the position of the toner supply container 5 is fixed relative to the apparatus main assembly 100 by a supporting pin 64 which projects from the rear plate 65. At the same time, the driving coupling 5*e* (female type) becomes connected with the driving coupling 62*b* (male type), enabling the screws 5*a* and stirring shaft 5*c* to be rotationally driven.

On the other hand, in order to pull the process cartridge 1 or toner supply container 5 out of the apparatus main assembly 100, the above-described mounting steps have only to be carried out in the reverse order. In this embodiment, the process cartridges 1 and the toner supply containers 5 are enabled to be mounted into, or dismounted from, the apparatus main assembly 100 in any order. In other words, the process cartridge 1 can be mounted into the apparatus main assembly 100 either before or after the toner supply container 5 is mounted into the apparatus main assembly 100. Further, the process cartridge 1 can be pulled out of the apparatus main assembly 100 either before or after the toner supply container 5 is pulled out of the apparatus main assembly 100.

Embodiments

Referring to FIGS. 1–24, the embodiments of the present invention will be described.

Figure 6:
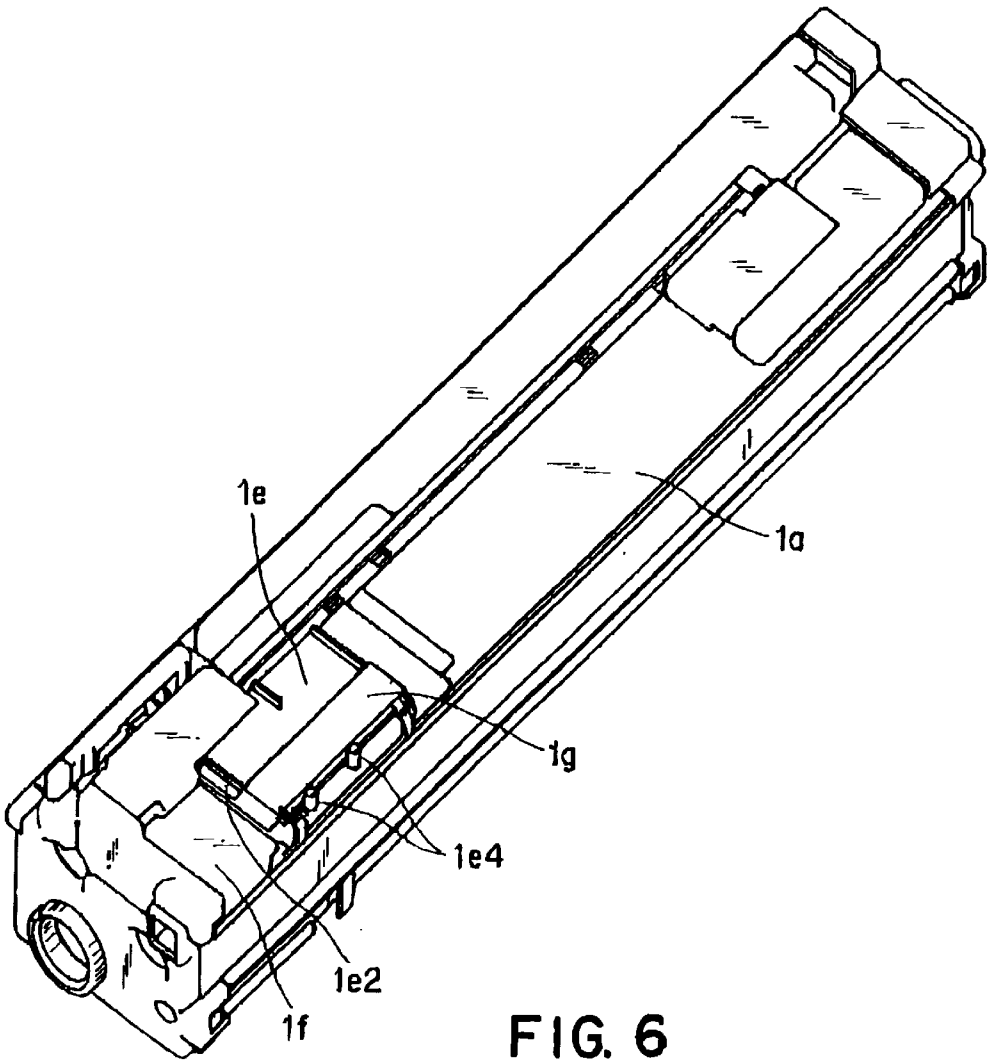
FIG. 6 is a perspective view of a process cartridge in which a toner inlet hole shutter and a toner inlet hole cover are closed, as seen from the rear side.
Figure 7:
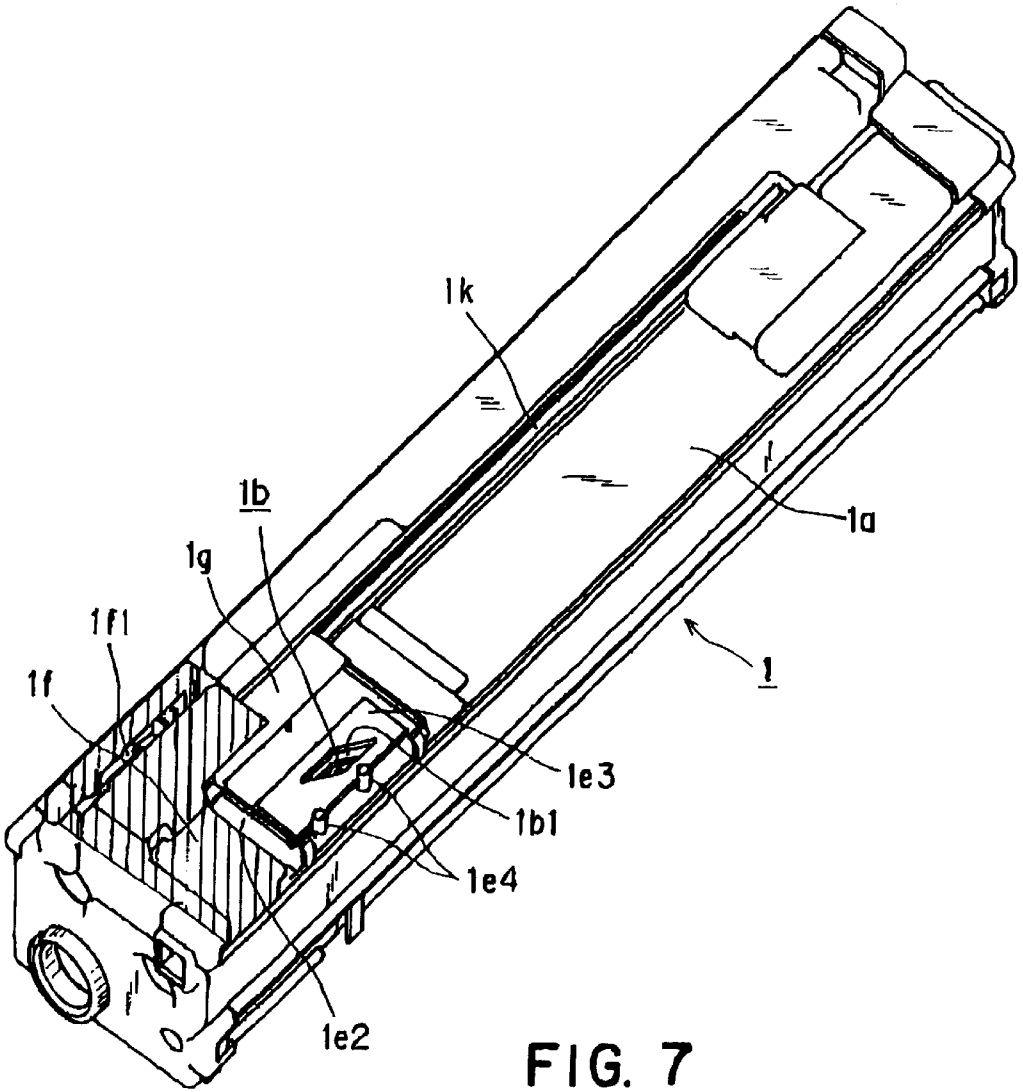
FIG. 7 is a perspective view, as seen from the rear side, of the process cartridge with the toner inlet hole shutter and the toner inlet hole cover being opened.
Figure 8:
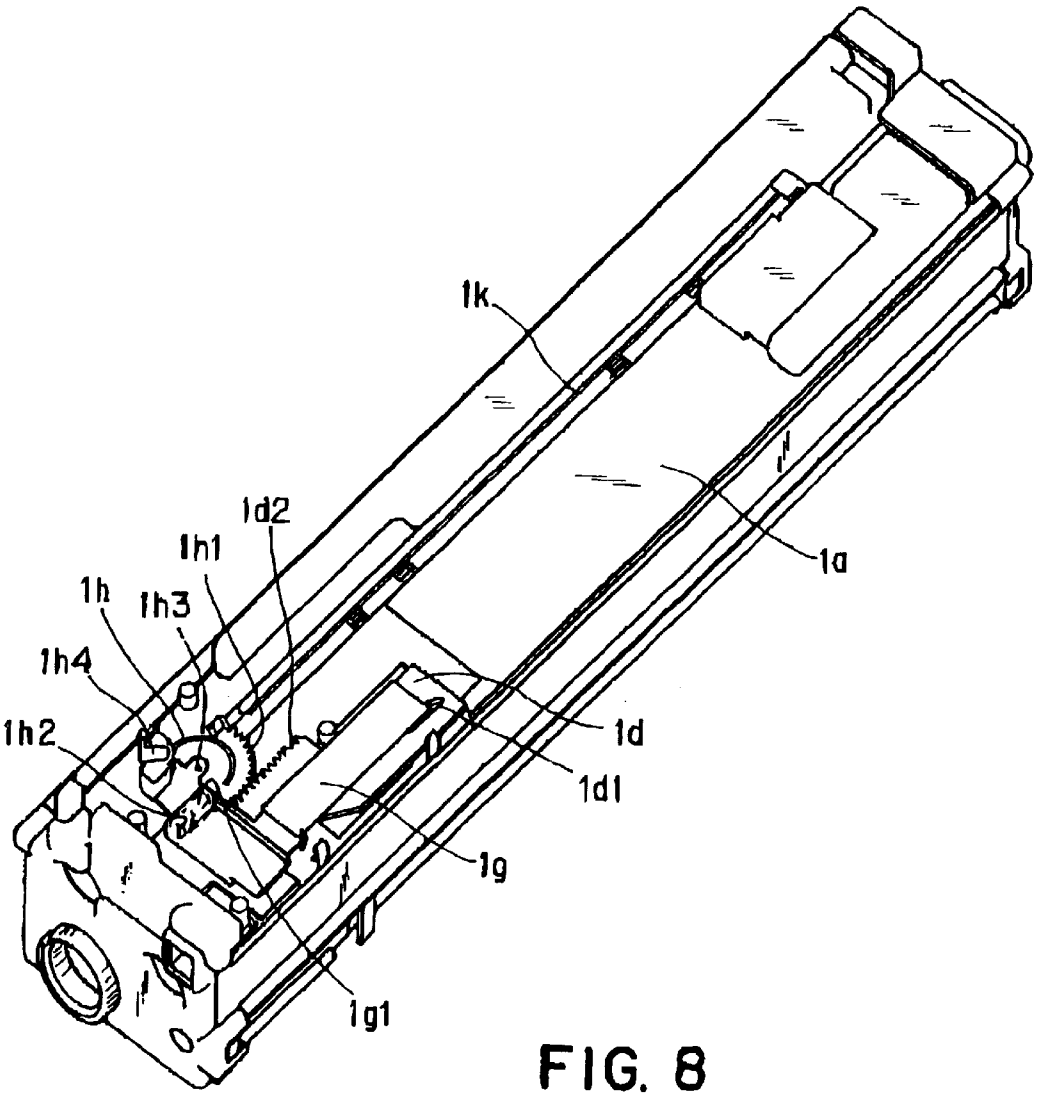
FIG. 8 is a perspective view, as seen from the rear side, of the process cartridge in which a member above a shutter opening and closing mechanism is removed to expose the shutter opening and closing mechanism.
Figure 9:
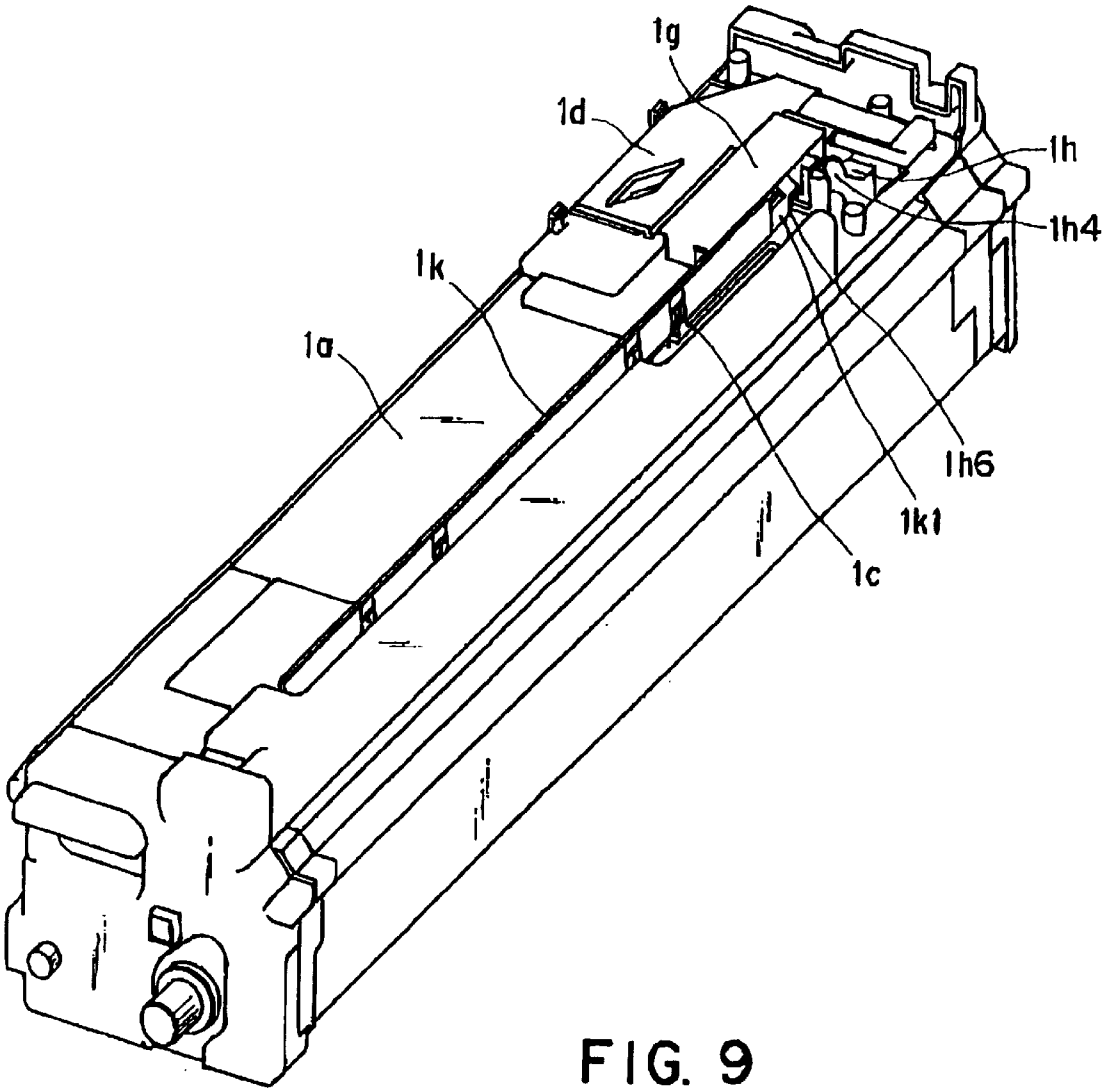
FIG. 9 is a perspective view, as seen from a front side, of a process cartridge in which the toner inlet hole shutter and the toner inlet hole cover are opened, and in which the shutter opening and closing mechanism are exposed.

FIGS. 6, 7 and 8 are perspective views of a process cartridge as seen from a rear side thereof, wherein FIG. 6 is a view in which a toner inlet hole shutter 1*d* (first opening and closing member) and a toner inlet hole cover (second opening and closing member) 1*g* are closed, and FIG. 7 is a view in which the shutter 1*d* and the cover 1*g* are opened. FIG. 8 is a view in which a cover above the shutter opening and closing mechanism is removed to expose the inside. FIG. 9 is a perspective view of a process cartridge 1 as seen from a front side, in which the shutter 1*d* and the cover 1*g* are open, and the cover of the shutter opening and closing mechanism is removed to expose the inside.

Connecting Portion of Process Cartridge

Figure 13:
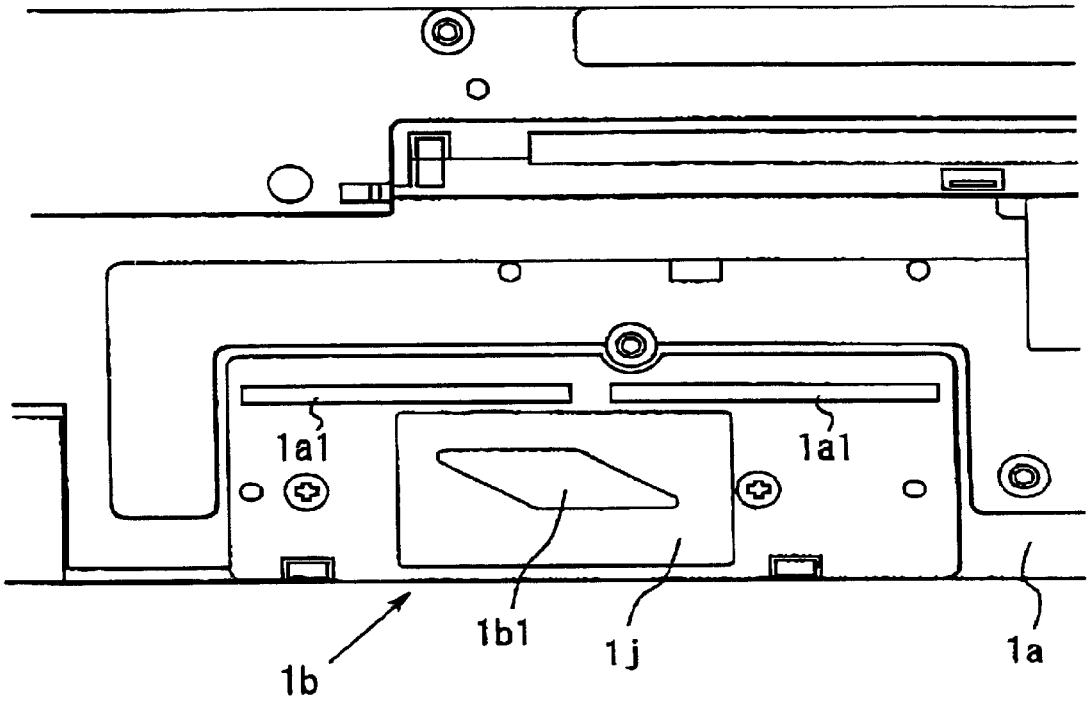
FIG. 13 is a top plan view with the process cartridge in which the inlet hole shutter is removed, according to an embodiment of the present invention.

FIG. 13 is an enlargement of a connecting portion between the process cartridge 1 and the toner supply container 5, in which the shutter 1*d* mounted to the upper portion is removed. As shown in FIG. 13, an upper surface of a frame 1*a* constituting a part of a process cartridge 1 is provided with an inlet hole 1*b* for connection with an opening 5*f* of a toner supply container 5, and in the inlet hole 1*b*, there is provided an inlet hole 1*b*1 which is a through-hole for permitting toner supply from the toner supply container 5. In this embodiment, the inlet hole 1*b* is disposed at the drive transmission side of the photosensitive drum 2, that is, at the rear side in the inserting direction of the process cartridge 1.

A seal member 1*j* is bonded on the upper surface of the frame 1*a* around the inlet hole 1*b*1, and the seal member 1*j* is provided with an opening substantially the same as the inlet hole 1*b*1. The material of the seal member 1*j* is preferably elastic and preferably has a low surface sliding resistance, and in this embodiment, comprises a urethane foam and a sliding sheet bonded on the upper surface thereof.

On the upper surface of the frame 1*a*, two guide grooves 1*a*1 are formed on a line. The guide grooves 1*a*1 are linear and parallel with the longitudinal direction.

Figure 14A:
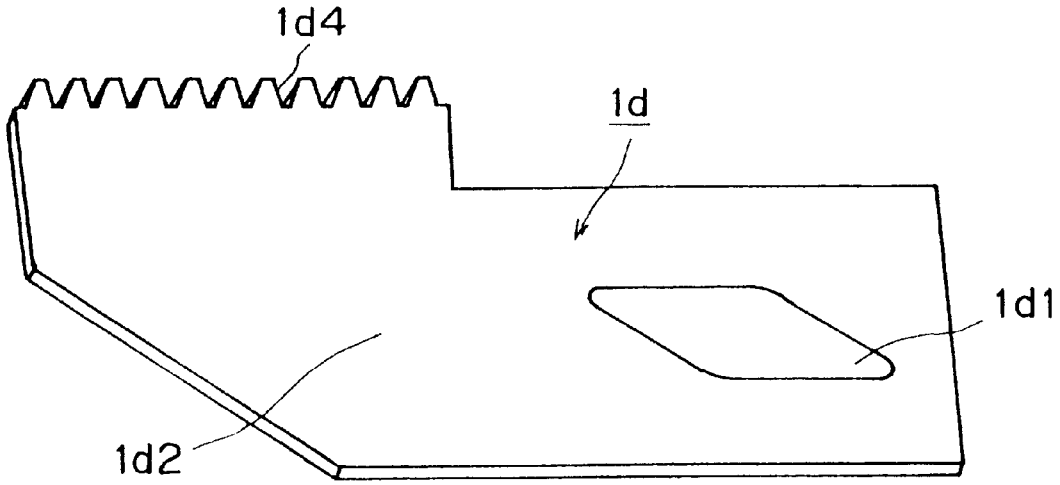
FIG. 14(*a*) illustrates a front side of the inlet hole shutter, and FIG. 14(*b*) shows a rear side thereof.
Figure 14B:
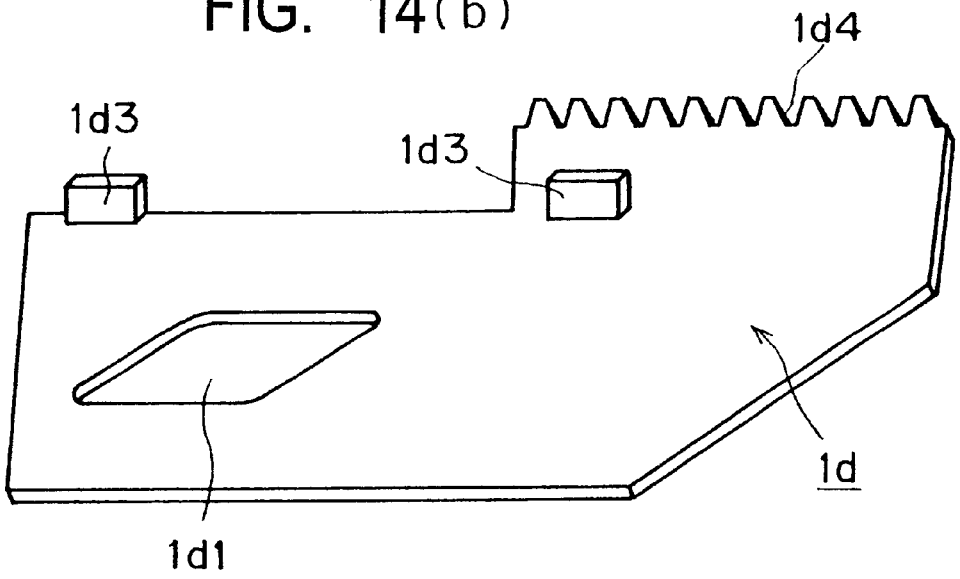

Referring to FIG. 14, a description will be provided as to an inlet hole shutter 1*d* mounted on the seal member 1*j*. FIG. 14(*a*) is a view of an inlet hole shutter 1*d* as seen from a front side, and FIG. 14(*b*) is a view of the inlet hole shutter 1*d* as seen from the back side. As shown in FIG. 14(*a*), the upper left -part of the inlet hole shutter 1*d* is provided with a rack 1*d*4 for meshing engagement with a circular gear for conversion of a rotational motion to a linear motion. The inlet hole shutter 1*d* has an opening 1*d*1 having substantially the same configuration as the hole of the inlet hole 1*b*1, and the left side of the opening 1*d*1 constitutes a shielding wall 1*d*2.

As shown in FIG. 14(*b*), the back side of the inlet hole shutter 1*d* is provided with two guiding ribs 1*d*3. When the inlet hole shutter 1*d* is placed on a seal member 1*j* as shown in FIG. 13, the guiding rib 1*d*3 is slidably engaged with a guide groove 1*a*1 so that inlet hole shutter 1*d* is guided along a guide groove 1*a*1 for linear movement in the longitudinal direction. When the inlet hole shutter 1*d* takes a righthand side position in FIG. 13, the inlet hole 1*b*1 is closed by a shielding wall 1*d*2 (FIG. 16), and when the inlet hole shutter 1*d* takes a left side in FIG. 13, the inlet hole 1*b*1 and the opening 1*d*1 are overlapped to permit the supply of the toner. The rack 1*d*4 and a line connecting the two guiding ribs 1*d*3 are parallel with each other. FIG. 17 shows a state between the state shown in FIG. 16 and a state shown in the FIG. 18.

Figure 18:
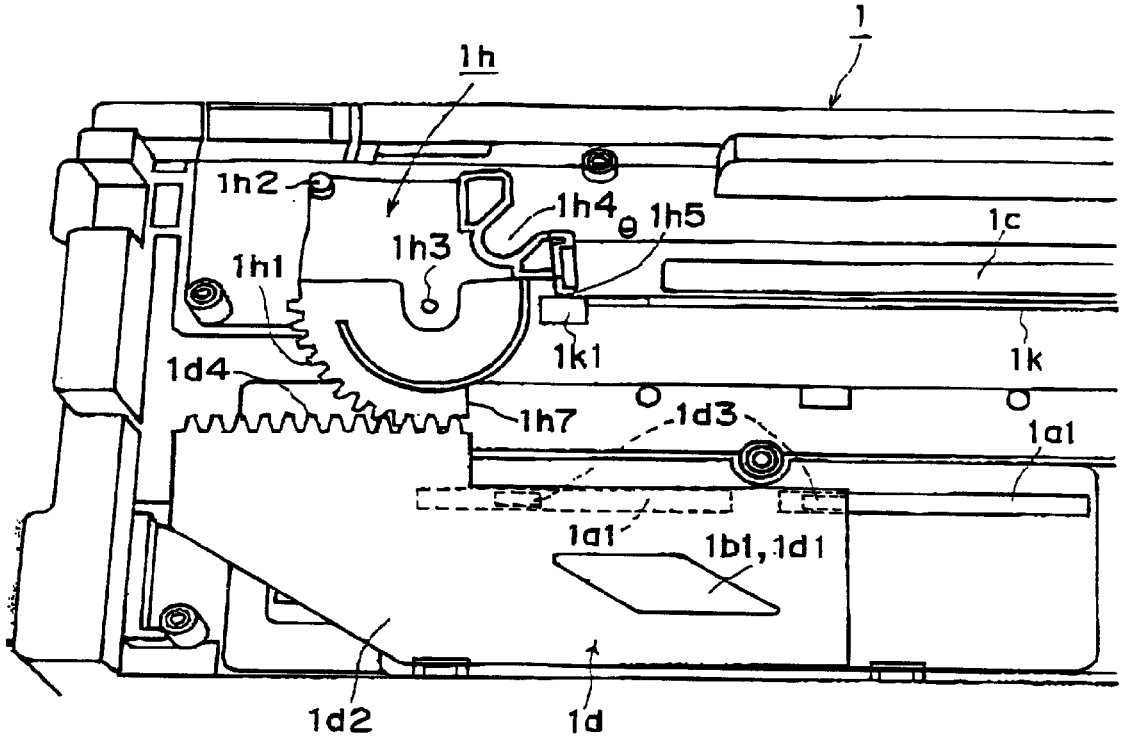
FIG. 18 is a perspective view illustrating a relation between the shutter opening and closing cam and the shutter when the inlet hole is not closed by the inlet hole shutter.

As shown in FIG. 18, the top surface of the frame 1*a* is provided with an exposure opening 1*c* for passing of a laser beam L. A laser shutter (third opening and closing member) 1*k* is rotatably mounted to the frame 1*a* to prevent the photosensitive drum 2 from being exposed to external light when the process cartridge 1 is taken out of the main assembly 100 of the apparatus. The laser shutter 1*k* operates in interrelation with a motion of the shutter opening and closing cam 1*h* to open and close the shutter. Here, the laser shutter 1*k* is rotatably mounted on the frame 1*a* at a rotation center 1*k*3 (FIG. 19) in the longitudinal direction.

Figure 15:
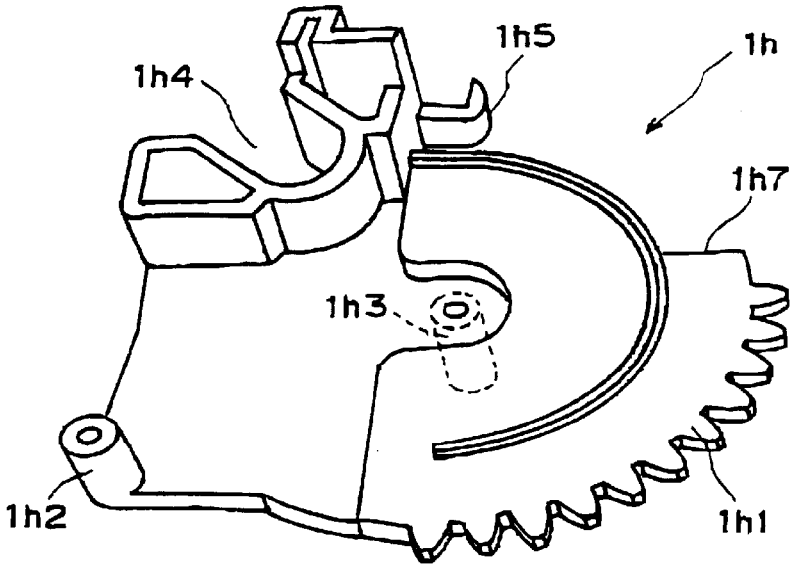
FIG. 15 is a perspective view of a shutter opening and closing cam.

Referring to FIG. 15, a description will be provided as to a shutter opening and closing cam 1*h*. The shutter opening and closing cam 1*h* is provided with a gear portion 1*h*1 over a ¼ circumference, and one end of the portion 1*h*1 constitutes an end surface 1*h*7. The shutter opening and closing cam 1*h* is provided with a pin 1*h*2 extending substantially vertically upward. The backside is provided with a center pin 1*h*3, which is rotatably supported in a hole formed in the frame 1*a* such that the shutter opening and closing cam 1*h* is rotatable about the center pin 1*h*3.

There is formed a cam portion 1*h*4 at a position generally opposite from the gear portion i*h* with respect to the center pin 1*h*3. A cam portion 1*h*4, in the form of a slit or the like extended toward the center pin 1*h*3 and engageable with a pin 67 provided in the main assembly 100 of the apparatus, will be described hereinafter. At a side of the cam portion 1*h*4, there is provided an engaging portion 1*h*5 which cooperates with the abutment end surface 1*h*7 to open and close the laser shutter 1*k*.

Figure 16:
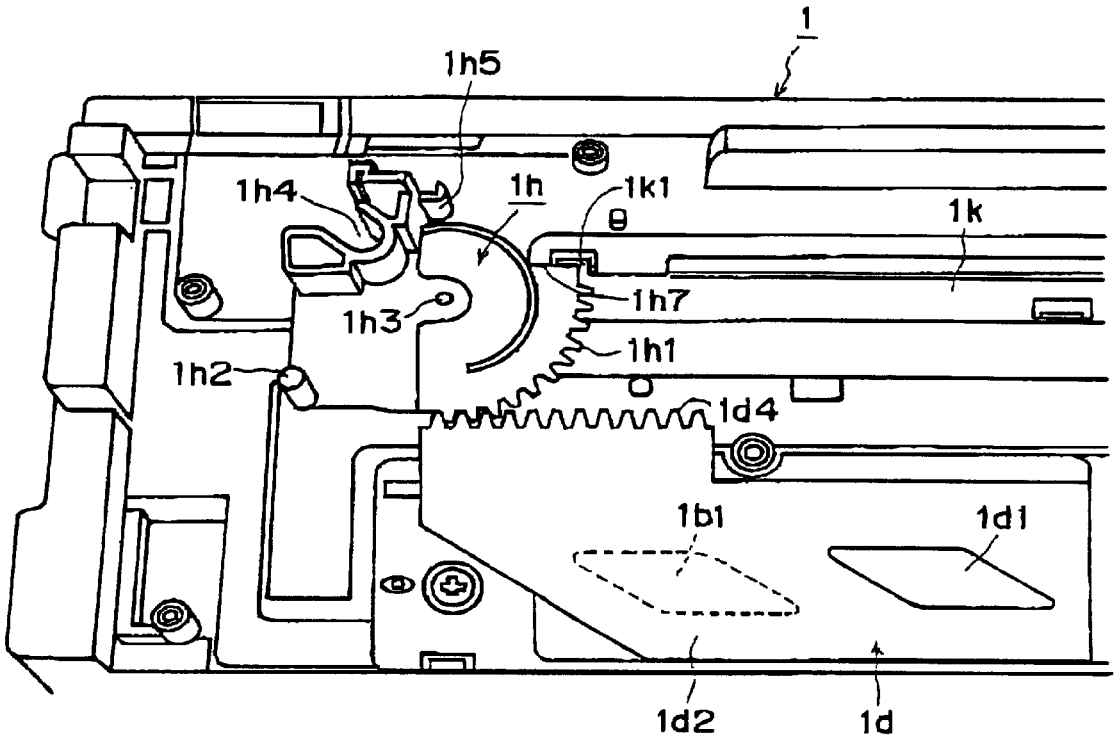
FIG. 16 is a perspective view illustrating a relation between the shutter opening and closing cam and the shutter when the inlet hole is closed by the inlet hole shutter.
Figure 17:
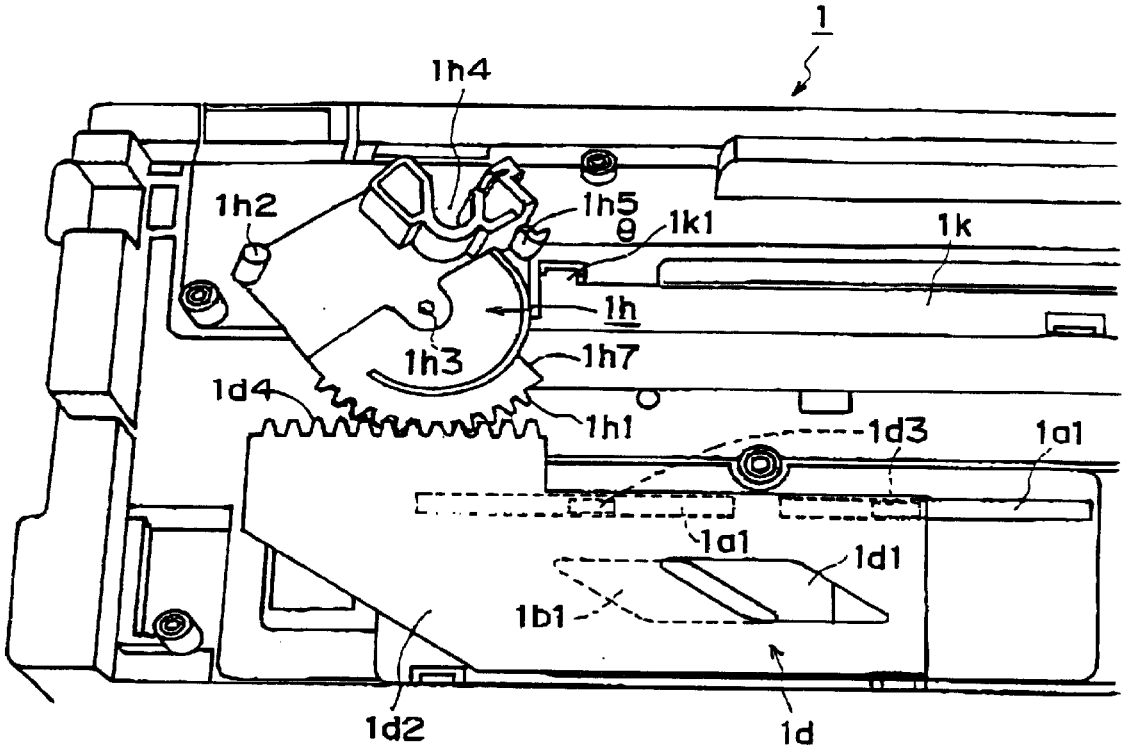
FIG. 17 is a perspective view illustrating a relation between the inlet hole shutter and the shutter opening and closing cam in the state between the states shown in FIG. 16 and FIG. 17.

Referring to FIGS. 16–19, a description will be provided as to an operation relation among the shutter opening and closing cam 1*h*, the inlet hole shutter 1*d* and the laser shutter 1*k*. FIG. 16 to FIG. 18 show the opening operation of the inlet hole shutter 1*d* and the laser shutter 1*k*. In FIG. 16, the inlet hole shutter 1*d* takes the right side position in which the inlet hole 1*b*1 and the opening 1*d*1 are not aligned, and therefore, the inlet hole 1*b*1 is closed by the shielding wall 1*d*2. At this time, the abutment end 1*h*7 of the shutter opening and closing cam 1*h* is abutted to the opening and closing portion 1*k*1 of the laser shutter 1*k*, so that the laser shutter 1*k* is closed. The gear portion 1*h*1 of the shutter opening and closing cam 1*h* and the rack 1*d*4 of the inlet hole shutter 1*d* are in meshing engagement with each other.

As shown in FIG. 17, when the shutter opening and closing cam 1*h* is rotated above the center pin 1*h*3, the rotating operation of the shutter opening and closing cam 1*h* is converted to a linear motion of the inlet hole shutter 1*d* due to the engagement of the rack 1*d*4 with the gear portion 1*h*1, so that the inlet hole shutter 1*d* moves to the left in the figure. At this time, the guiding rib 1*d*3 provided on the back side of the inlet hole shutter 1*d* is engaged with the guide groove 1*a*1 and slides along the guide, so that the inlet hole shutter 1*d* movements lead nearly toward the left in the longitudinal direction along the guide groove 1*a*1.

As shown in FIG. 18, when the shutter opening and closing cam 1*h* further rotates, the inlet hole shutter 1*d* moves to the left side, and stops at such a position that the opening 1*d*1 is overlapped with the inlet hole 1*b*1. In addition, an engaging portion 1*h*5 of the shutter opening and closing cam 1*h* abuts the opening and closing portion 1*k*1 to raise it, thus opening the laser shutter 1*k*. In this manner, the exposure opening 1*c* is opened.

Conversely, when the shutter opening and closing cam 1*h* is rotated in the counterclockwise direction about the center pin 1*h*3, the inlet hole shutter 1*d* moves to the right side to close the inlet hole 1*b*1 with the shielding wall 1*d*2. As shown in FIG. 16, the abutment end surface 1*h*7 of the shutter opening and closing cam 1*h* abuts the laser shutter 1*k*, by which the laser shutter 1*k* is tilted to close.

Figure 19A:
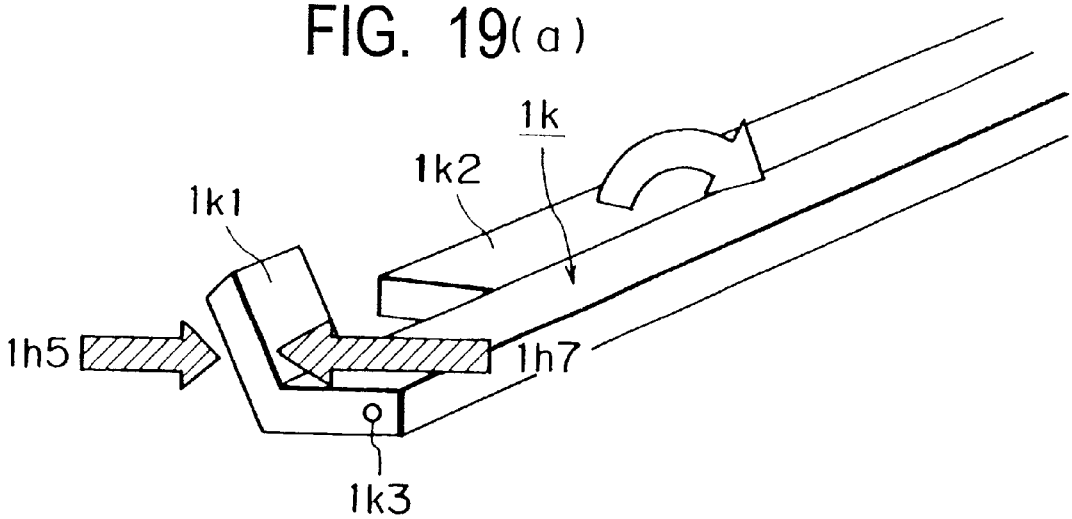
FIGS. 19(*a*) and 19(*b*) are schematic views illustrating a relation between opening and closing of the laser shutter and the shutter opening and closing cam.
Figure 19B:
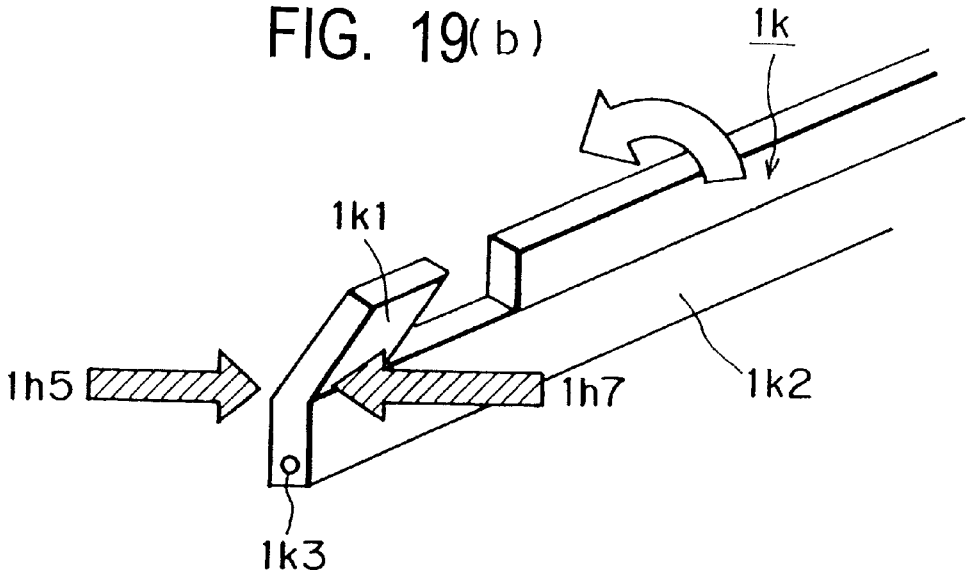

Referring to FIGS. 19(*a*) and 19(*b*) a description will be provided as to an opening and closing operation of the laser shutter 1*k* by the shutter opening and closing cam 1*h*. FIG.

19(*a*) shows a state in which the laser shutter 1*k* is closed, and FIG. 19(*b*) shows a state in which the laser shutter 1*k* is open. In the state shown in FIG. 19(*a*), the upper surface of the opening and closing portion 1*k*1, inclined by approximately 45° retroactive to the shutter surface 1*k*2 of the laser shutter 1*k*, receives a force from the right side in the figure by the abutment end surface 1*h*7 of the shutter opening and closing cam 1*h*, and the laser shutter 1*k* in the close state (sealing state). When the shutter opening and closing cam 1*h* rotates, the engaging portion 1*h*5 of the shutter opening and closing cam 1*h* abuts the bottom surface of the opening and closing portion 1*k*1 as shown in FIG. 19(*b*), so that a force is applied from the left side in the figure to raise the opening and closing portion 1*k*1, thus making erect the shutter surface 1*k*2, and thus opening the laser shutter 1*k* (opening state).

Conversely when the laser shutter 1*k* is closed, the force is applied by the abutment end surface 1*h*7 of the shutter opening and closing cam 1*h* from the righthand side in the FIG. 19, (*b*) (opening state). As shown in FIG. 19(*a*), the shutter surface 1*k*2 is tilted to close the laser shutter 1*k* (sealing state).

When the laser shutter 1*k* is in the closing position, the end surface 1*h*7 of the cam 1*h* contacts the opening and closing portion 1*k*1, and therefore, the laser shutter 1*k* is prohibited from opening unless the cam 1*h* is rotated.

As described in the foregoing, the inlet hole shutter 1*d* and the laser shutter 1*k* are opened and closed by the rotating operation of the shutter opening and the closing cam 1*h*.

Figure 20:
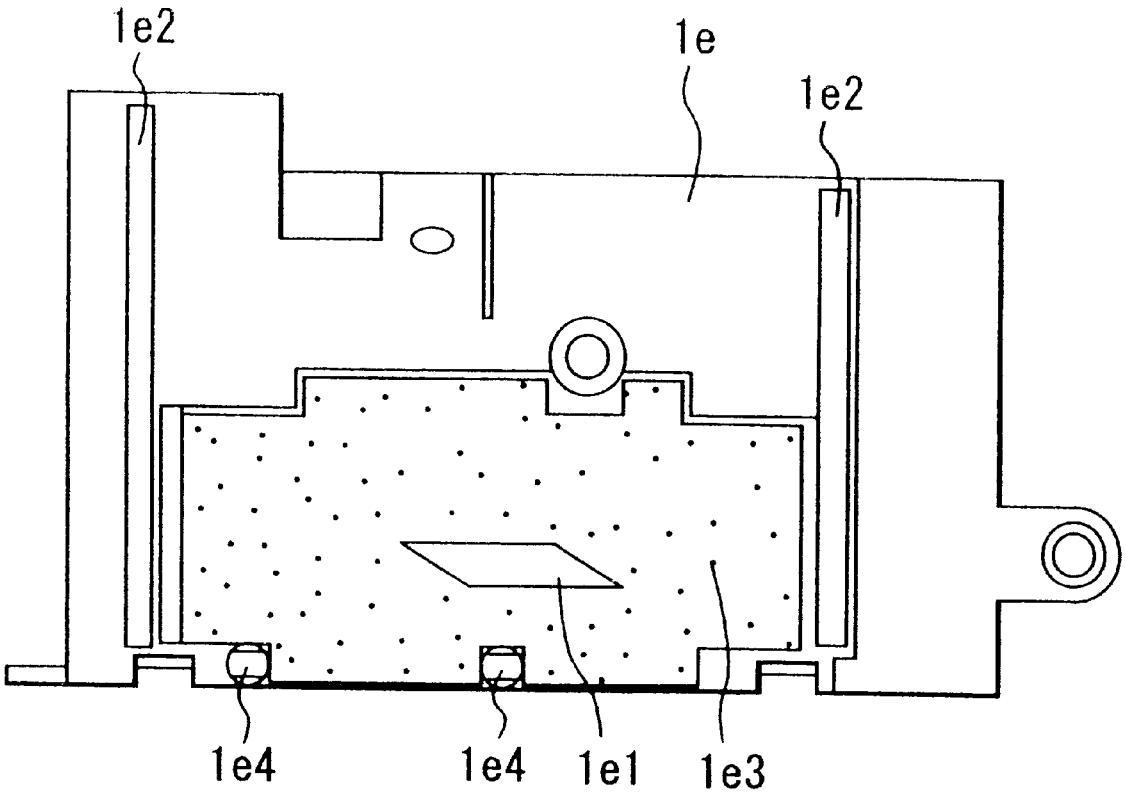
FIGS. 20(*a*) and 20(*b*) are a top plan view of a first pushing member and a side view of the first pushing member.
Figure 20:
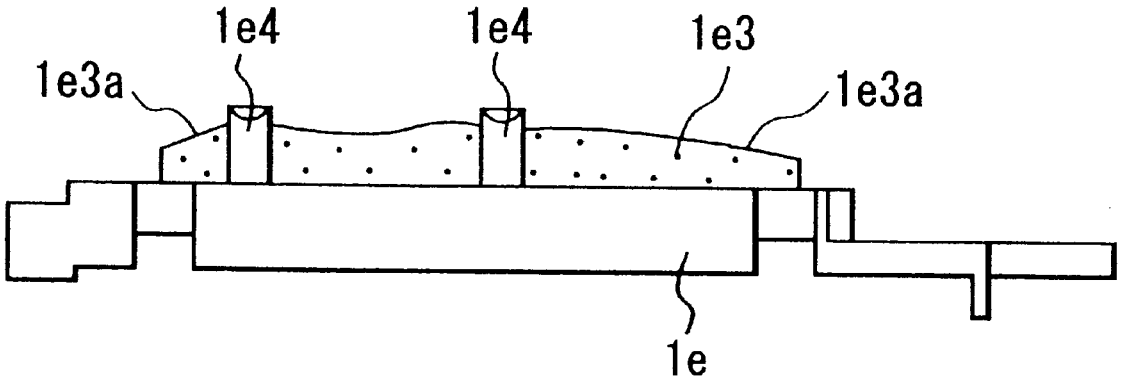

Referring to FIGS. 20(*a*) and 20(*b*), a description will be provided as to a first pushing member 1*e* for urging the inlet hole shutter 1*d* from the top to prevent disengagement from the frame 1*a*. FIG. 20(*a*) is a top plan view of the first pushing member 1*e* as seen from the top side, and FIG. 20(*b*) is a side view of the first pushing member 1*e*.

As shown in FIG. 20(*a*), the first pushing member 1*e* is provided with an opening 1*e*1 having substantially the same configuration corresponding to the toner inlet hole 1*b*1 (supply portion), and an elastic seal member 1*e*3 is bonded around the opening 1*e*1. At a lower positioned in the figure, there are provided two projected guide pins 1*e*4 for rotating an outlet hole shutter 5*f*3 provided in the toner supply container 5 which will be described hereinafter. The inlet hole 1*b*1 is a through-hole, and a seal member 1*e*3 is provided so as to cover the circumference.

The seal member 1*e*3, when it is contacted to the toner supply container 5, functions to maintain the sealing property. It preferably has an elasticity, and exhibits a good toner wiping or scraping property with low sliding resistance. The seal member 1*e*3 may be a Teflon felt, a Teflon pile, an urethane foam or a material provided by electrostatic flock material, or the like.

As shown in FIG. 20(*b*), when the seal member 1*e*3 is seen in the direction of the thickness, it is not of a rectangular shape, but left and right portions are lowered to provide left and right inclined surfaces 1*e*3*a*. By the provision of the inclined surfaces 1*e*3*a* with the seal member 1*e*3, the toner supply container 5 can be smoothly contacted.

The first pushing member 1*e* is placed over the shutter opening and closing cam 1*h* and the inlet hole shutter 1*d* shown in FIG. 16, by which the shutter opening and closing cam 1*h* and the inlet hole shutter 1*d* are prevented from disengaging from the frame 1*a*. At this time, the opening 1*e*1 formed in the first pushing member 1*e* is in alignment with the inlet hole 1*b*1. As shown in FIG. 20(*a*), the first pushing member 1*e* is provided with two guide grooves 1*e*2 at both of the sides of the seal member 1*e*3. The guide groove 1*e*2 is in the form of a groove which is linearly extended along the short side, and the guide grooves 1*e*2 are parallel with each other. Along the guide grooves 1*e*2, an inlet hole cover 1*g*, which will be described hereinafter, moves in the direction perpendicular to the longitudinal direction.

Figure 21A:
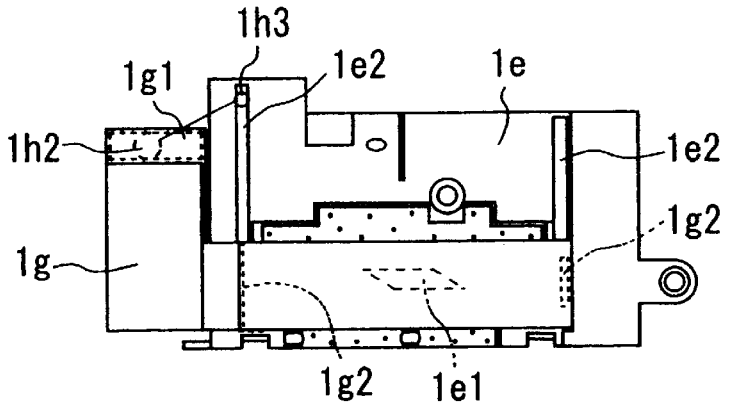
FIGS. 21(*a*) to 21(*c*) are schematic views illustrating a relation between the inlet hole cover and the shutter opening and closing cam.
Figure 21B:
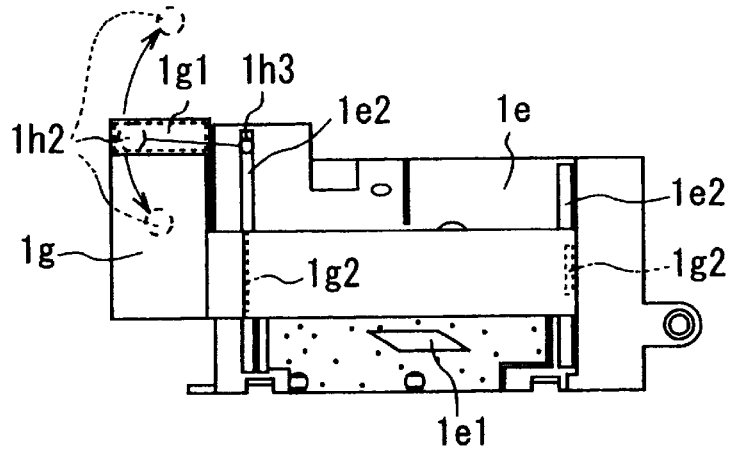
Figure 21C:
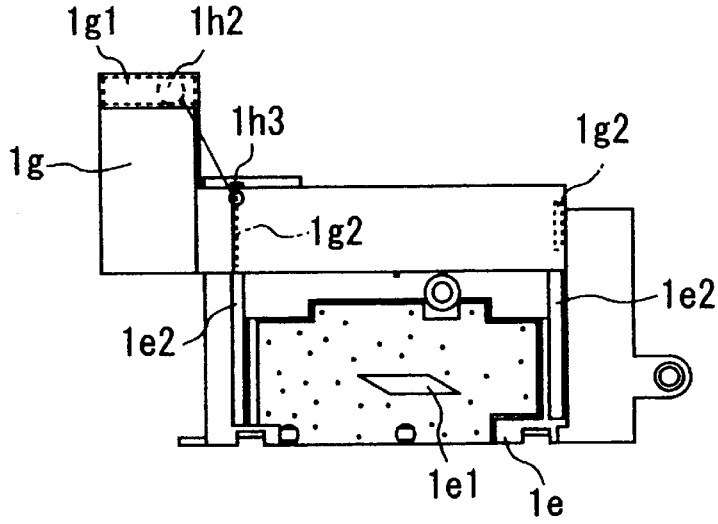

On the first pushing member 1*e*, there is provided an inlet hole cover 1*g* as shown in FIGS. 21(*a*)–21(*c*). The inlet hole cover 1*g* is L-shaped, and the backside thereof is provided with guiding ribs 1*g*2 which are projected for slidable engagement with the two guide grooves 1*e*2. The inlet hole cover 1*g* is guided by the guide groove 1*e*2 along the short side to slide until it closes or opens the opening 1*e*1 formed in the first pushing member 1*e*.

In other words, the inlet hole shutter 1*d* and the inlet hole cover 1*g* move in directions which are perpendicular to each other.

In this embodiment, the inlet hole cover 1*g* is moved in a direction perpendicular to the longitudinal direction, but the moving direction of the inlet hole cover 1*g* is not limited to this direction, but may be any direction which is different from the mounting-and-demounting of the process cartridge 1 relative to the main assembly 100 of the apparatus.

Figure 12:
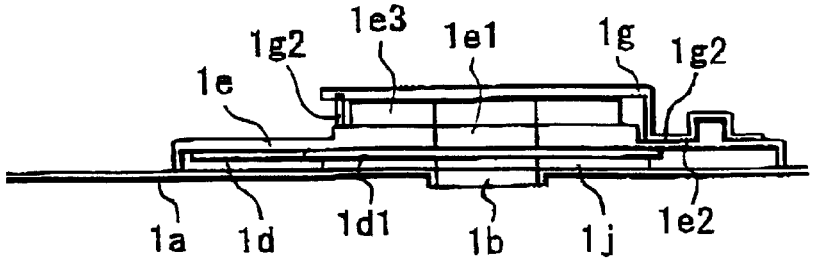
FIG. 12 is a longitudinal sectional view of a shutter portion of a process cartridge.

FIG. 12 is a longitudinal sectional view of the device shown in FIG. 21(*a*), as seen from the top side. A seal member 1*j* is provided on the inlet hole 1*b*1 formed in the frame 1*a*, and an inlet hole shutter 1*d* is provided further thereon. The inlet hole shutter 1*d* is movably supported on the frame 1*a* by the first pushing member 1*e*, and an inlet hole cover 1*g* is movably mounted so as to cover the seal member 1*e*3 provided on the first pushing member 1*e*.

Referring to FIGS. 21(*a*)–21(*c*), a description will be provided as to operational relationship between the inlet hole cover 1*g* and the shutter opening and closing cam 1*h*. In FIGS. 21(*a*)–21(*c*), the shutter opening and closing cam 1*h* is not shown in detail, and the center of rotation 1*h*3 of the shutter opening and closing cam 1*h* and pin 1*h*2 only are shown schematically.

In FIG. 21(*a*), the inlet hole cover 1*g* closes the opening 1*e*1 (inlet hole 1*b*1). The inlet hole cover 1*g* is provided in the back side with a groove 1*g*1 that is linearly extended in the longitudinal direction, and a pin 1*h*2 formed on the shutter opening and closing cam 1*h* is movably engaged with the groove 1*g* 1. As shown in FIGS. 16 and 21(*a*), when the inlet hole cover 1*g* closes the opening 1*e*1 (inlet hole 1*b*1), the pin 1*h*2 is disposed substantially at the center portion of the groove 1*g* 1.

As shown in FIGS. 17 and 21(*b*), when the shutter opening and closing cam 1*h* rotates in the clockwise direction about the center pin 1*h*3, the pin 1*h*2 moves along the circumference, and the inlet hole cover 1*g* moves upward in the figure with the movement of the pin 1*h*2 in the circumferential direction. The pin 1*h*2 lifts the inlet hole cover 1*g* while moving in the groove 1*g*l toward the left side in the longitudinal direction (leftward in FIG. 21(*b*)).

With the rotation of the shutter opening and closing cam 1*h*, the pin 1*h*2 moves along the circumferential direction, in response to which the inlet hole cover 1*g* moves upwardly as shown in FIGS. 18 and 21(*c*). The pin 1*h*2 lifts the inlet hole cover 1*g* while moving to the righthand side in the longitudinal direction (to the righthand side in FIG. 21(*c*)), so as to open the opening 1*e*1 formed in the first pushing member 1*e*.

When the opening 1*e*1 is closed by the inlet hole cover 1*g* from the state shown in FIG. 21(*c*), the shutter opening and closing cam 1*h* is rotated in the counterclockwise direction, by which the inlet hole cover 1*g* lowers in the figure to close the opening 1*e*1, conversely to the foregoing.

As shown in FIG. 7, the inlet hole cover 1*g* is provided thereon with a second pushing member 1*f* (hatched portion) to prevent disengagement of the inlet hole cover 1*g*. The second pushing member 1*f* is provided with a slit 1*f*1, which it extended linearly in the longitudinal direction. When the process cartridge 1 is mounted to the main assembly 100 of the apparatus, the slit 1*f*1 is passed by a pin 67 projected in the main assembly 100 of the apparatus, as will be described hereinafter. The second pushing member 1*f* is provided with a claw 1*i*1 for engagement with the shutter opening and closing cam 1*h* to prevent rotation of the cam 1*h* and a locking member 1*i* having a releasing portion 1*i*2 for releasing the engagement (FIG. 10).

Figure 10:
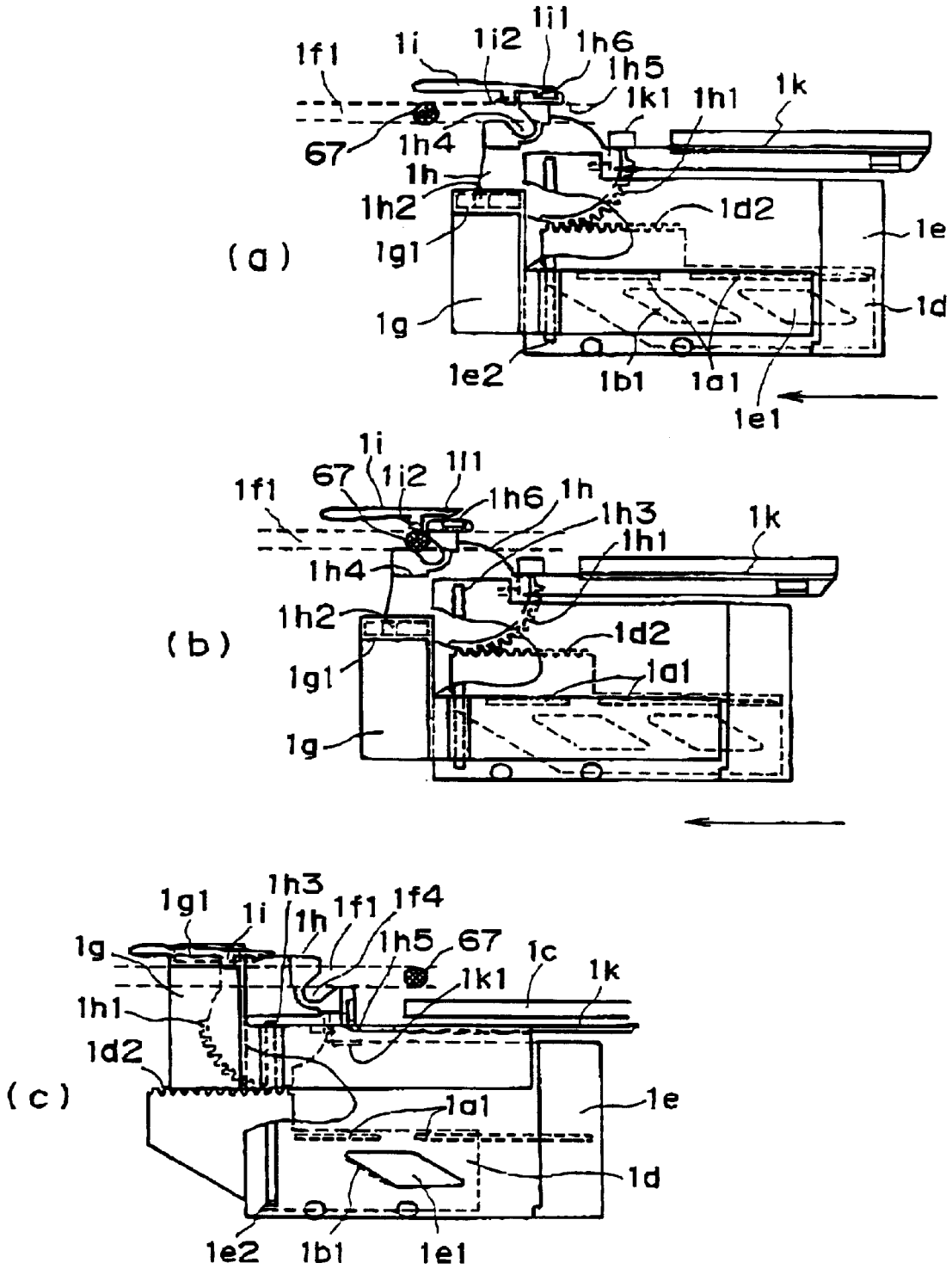
FIGS. 10(*a*) to 10(*c*) illustrate opening and closing operations of the toner inlet hole shutter, the inlet hole cover and the laser shutter of the process cartridge.

As shown in FIG. 10, before the process cartridge 1 is mounted to the main assembly 100 of the apparatus, the claw 1*i*1 is engaged in the engaging portion (groove) 1*h*6 of the cam 1*h*, and therefore, the cam 1*h* is locked (FIG. 10 (*a*)). When the process cartridge is inserted, the pin provided in the main assembly of the apparatus abuts the releasing portion to disengage the claw from the engaging portion (FIG. 10(*b*)), and with further insertion of the process cartridge, the pin is brought into engagement with the cam, thus rotating the cam (FIG. 10(*c*)).

As described in the foregoing, the rotating operation of the shutter opening and closing cam 1*h* accomplishes three actions, namely, opening and closing operations of the inlet hole shutter 1*d*, the laser shutter 1*k*, and the inlet hole cover 1*g*. Before the start of use of the process cartridge 1, the inlet hole shutter 1*d* takes the first position in which the inlet hole shutter 1*d* closely contacts the seal member 1*j* of the opening 1*b*, so that inlet hole 1*b*1 is closed. Also, the inlet hole cover 1*g* is at the first position for covering the opening 1*e*1 formed in the first pushing member 1*e*, so that the opening is closed.

Connecting Portion of Toner Supply Container

A description will be provided as to the connecting portion of the toner supply container 5.

As shown in FIG. 2, the first opening 5*f*5 is formed below the screw 5*a*, and the first seal member 5*f*6 is provided below the first opening 5*f*5. In this embodiment, the outlet hole 5*f* is provided in the drive transmission side of the screw 5*a*, and is disposed at a rear side with respect to an inserting direction of the container.

The first sealing member 5*f*6 is provided to prevent toner from leaking from the edge of the first hole 5*f*5. It is an elastic member with a predetermined thickness, and its opening is the same in shape as that of the first hole 5*f*5. The first sealing member 5*f*6 is pasted to the peripheries of the bottom opening of the first hole 5*f*5, by its upwardly facing surface, with its opening in alignment with the first hole 5*f*5. In this embodiment, foamed urethane is used as the material for the first sealing member 5*f*6. However, the material choice for the first sealing member 5*f*6 does not need to be limited to foamed urethane; any elastic material may be used.

Below the first sealing member 5*f*6, a sealing plate 5*f*7 is located. The sealing plate 5*f*7 is pasted to the downwardly facing surface of the first sealing member 5*f*6, by its upwardly facing surface. Since the sealing plate 5*f*7 is supported by the first sealing member 5*f*6, it is allowed to move vertically or tilt within a range afforded by the elasticity of the first sealing member 5*f*6. The sealing plate 5*f*7 is provided with a third hole 5*f*7*a*, which is a through hole, and is alignment with the first hole 5*f*5. In other words, the toner outlet portion 5*f* is contrived so that the toner falls through the first hole 5*f*5, the hole of the first sealing member 5*f*6, and the third hole 5*f*7*a* of the sealing plate 5*f*7 in this order.

The bottom portion of the toner supply container 5 is provided with the toner outlet hole shutter 5*f*3 for opening or closing the first hole 5*f*5, and the toner outlet hole shutter holding member 5*f*2 that prevents the toner outlet hole shutter 5*f*3 from falling off, as well as connecting between the first hole 5*f*5 and the toner inlet 1*b* of the process cartridge 1. Referring to FIG. 2, the toner outlet hole shutter 5*f*3 is located below the sealing plate 5*f*7, and a second sealing member 5*f*8 is sandwiched between the toner outlet hole shutter 5*f*3 and sealing plate 5*f*7. The second sealing member 5*f*8 is for preventing toner from leaking from the peripheries of the opening of a second hole 5*f*3*b*, with which the toner outlet hole shutter 5*f*3 is provided, and which will be described later. It is an elastic member, and is disposed so that its hole aligns with the second hole 5*f*3*b*. The second sealing member 5*f*8 is pasted to the toner outlet hole shutter 5*f*3 by its downwardly facing surface, but its upwardly facing surface is not fixed to the downwardly facing surface of the sealing plate 5*f*7, being allowed to slide against the sealing plate 5*f*7. As for the material for the second sealing member 5*f*8, such substances that have elasticity and are low in the friction against the sealing plate 5*f*7, are preferable. More specifically, a sheet of foamed urethane, or a sheet of foamed urethane to which a low friction sheet has been pasted, or the like, may be used.

The bottom surface portion of the toner supply container 5 is further provided with an outlet hole cover 5*f*1 which covers the pushing member 5*f*2 and which is movable in the longitudinal direction.

Figure 23:
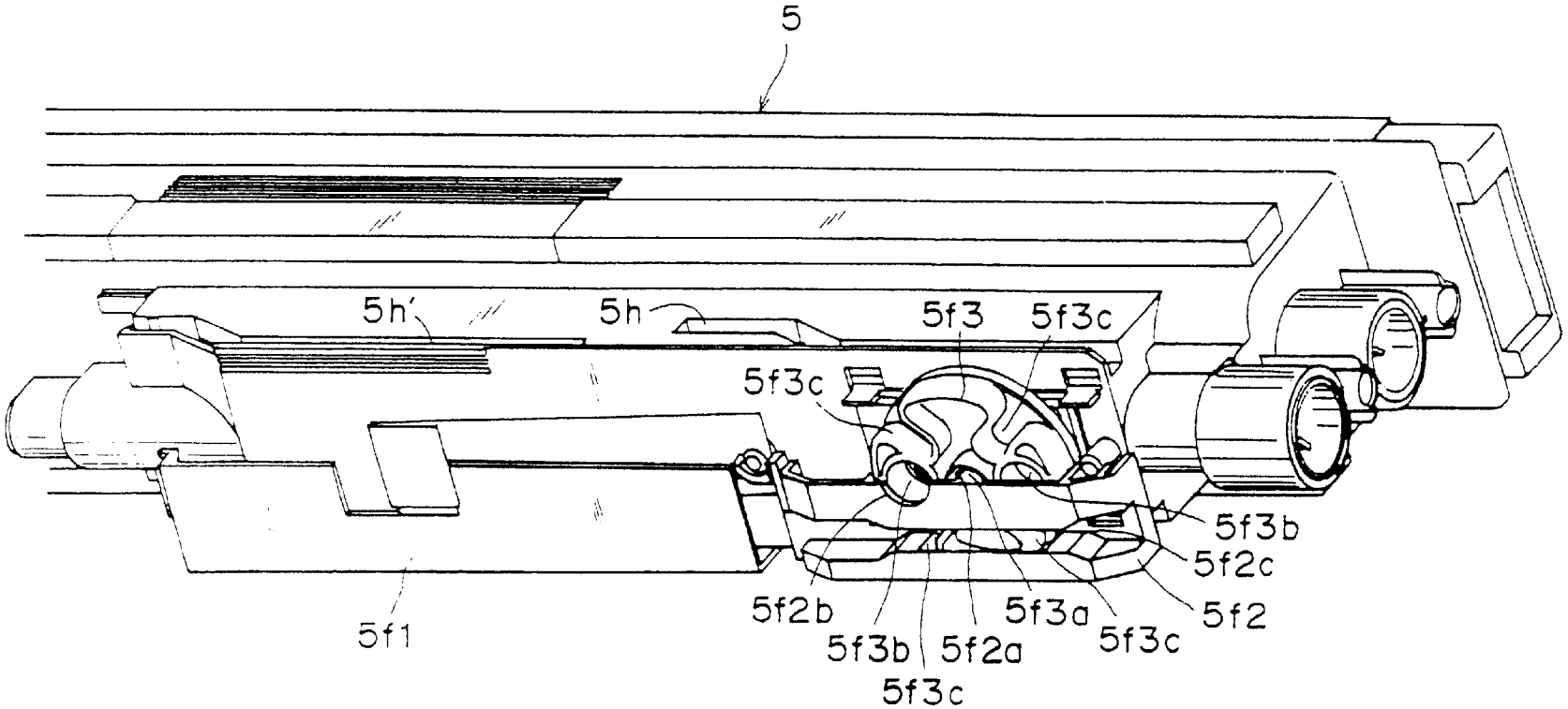
FIG. 23 is a partially enlarged perspective view illustrating an outlet hole of the toner supply container according to an embodiment of the present invention.

FIG. 23 is an enlarged perspective view of the toner outlet cover and the toner outlet hole shutter portions of the toner supply container 5, as seen diagonally below the bottom, rear, right corner of the toner supply container 5. In the drawing, the halves of the toner outlet cover 5*f*1 and the shutter holding member 5*f*2, with respect to their center lines parallel to the lengthwise direction of the toner supply container 5, have been removed for visual confirmation. As shown in the drawing, the toner outlet hole shutter 5*f*3 rotates about a rotational axis 5*f*3*a*. It has two second holes 5*f*3*b* symmetrically located with respect to the rotational axis 5*f*3*a*, and four slits 5*f*3*c*, which are engagement portions for rotating the shutter. The positions of the four slits 5*f*3*c* are offset from the adjacent second holes 5*f*3*b* by 45 degrees.

Figure 24:
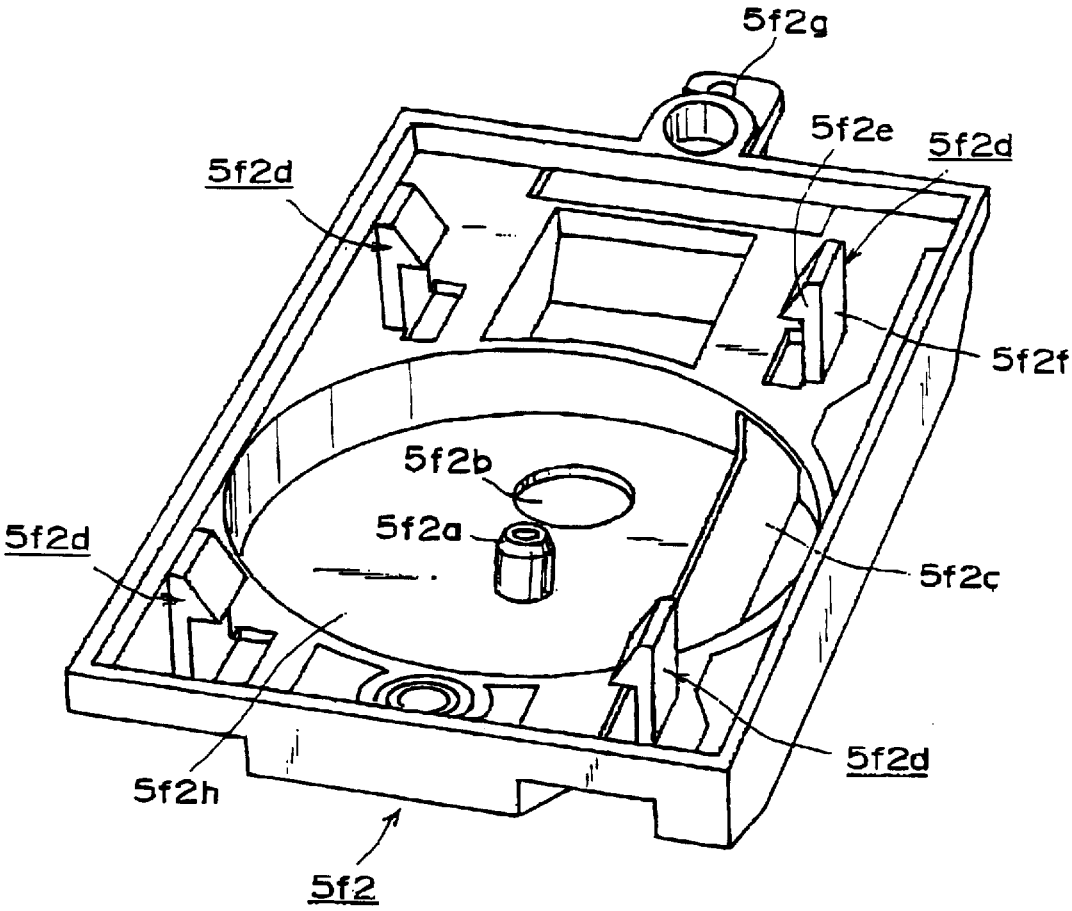
FIG. 24 is a perspective view of a pushing member of a toner supply container.

Referring to FIG. 24, the shutter holding member 5*f*2 will be described. FIG. 24 is a perspective view of the shutter holding member 5*f*2, which has been removed from the toner supply container 5. The shutter holding member 5*f*2 is provided with a pin 5*f*2*a*, which constitutes the rotational axis for rotationally supporting toner outlet hole shutter 5*f*3, a fourth hole 5*f*2*b*, that is, a through hole through which toner is supplied, and a slit 5*f*2*c* which extends approximately straight in the lengthwise direction of the shutter holding member 5*f*2. The pin 5*f*2*a* perpendicularly projects from the upwardly facing surface of the bottom wall 5*f*2*h* of the shutter holding member 5*f*2. The pin 5*f*2*a* rotationally supports the toner outlet hole shutter 5*f*3 by being fitted in the center hole 5*f*3*a* of the toner outlet hole shutter 5*f*3. The four corners of the shutter holding member 5*f*2 are provided with a pawl 5*f*2*d*, which projects upward. As the shutter holding member 5*f*2 is attached to the bottom plate 5*i* of the toner supply container 5 as shown in FIG. 2, each pawl 5*f*2*d* fits into the corresponding hole 5*i*1 in the bottom plate 5*i*, and the claw 5f2e of the pawl 5f2d, which projects inward of the pawl 5f2, catches the bottom plate 5i, locking the shutter holding member 5f2 to the bottom plate 5i in a manner of being hung from the bottom plate 5i.

The arm portion 5f2f of the pawl 5f2d is rendered long enough for the shutter holding member 5f2 to be kept pressed downward by the resiliency of the first sealing member 5f6. Further, the pawl 5f2d is fitted in the hole 5i1 of the bottom plate 5i with the presence of a certain amount of play so that the shutter holding member 5f2 is allowed to move left or right, or tilt, relative to the bottom plate 5i. In other words, the shutter holding member 5f2 is attached to the bottom plate 5i of the toner supply container 5 with the presence of a certain amount of play so that the shutter holding member 5f2 is allowed to move vertically, left or right, or tilt, relative to the bottom plate 5i. Consequently, the shutter holding member 5f2 is allowed to slightly move vertically, left, or right, or tilt, relative to the shell 5g.

Further, the shutter holding member 5f2, the toner outlet hole shutter 5f3, and the sealing plate 5f7 are enabled to slightly move together vertically, left or right, or slightly tilt, relative to the shell 5g.

Figure 22A:
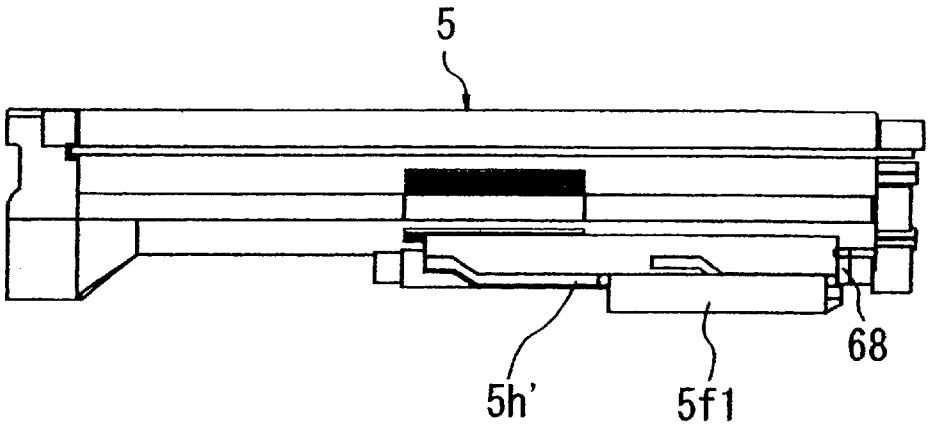
FIGS. 22(*a*) to 22(*c*) are side views of an outlet hole cover of a toner supply container illustrating an operation thereof.
Figure 22B:
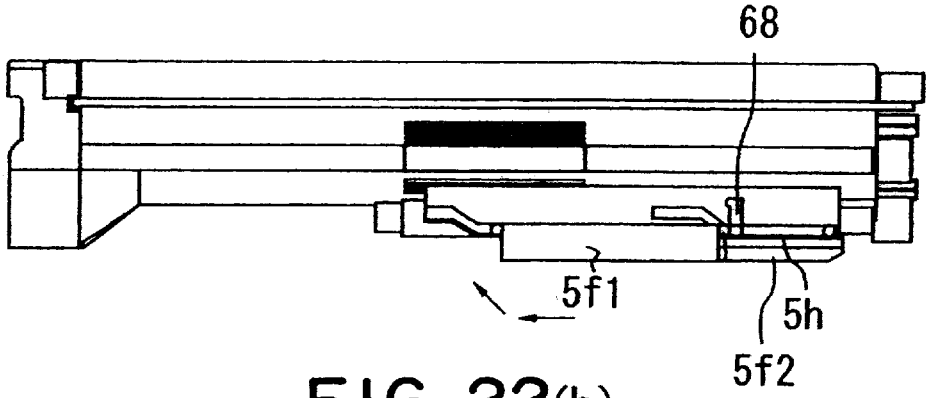
Figure 22C:
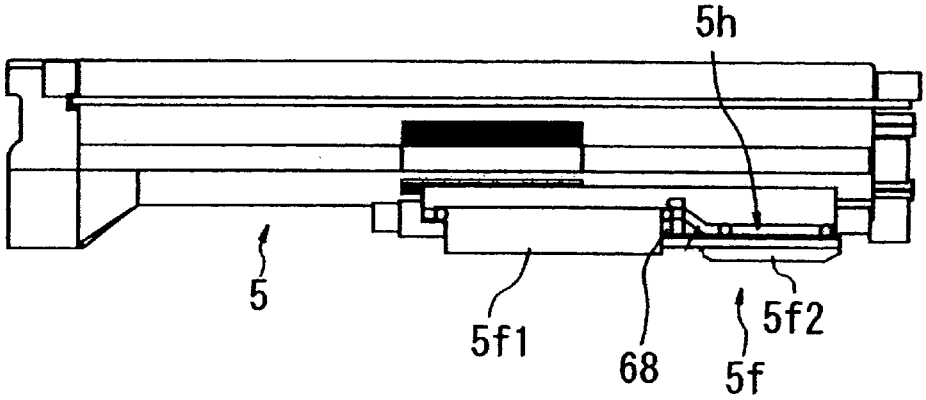

As shown in FIG. 22, the toner supply container 5 is provided with the toner outlet cover 5f1, which is attached to the toner supply container 5 in such a manner that the toner outlet cover 5f1 is enabled to cover the above-described shutter holding member 5f2, to be moved by the grooves 5h and 5h' of the toner supply container 5 toward the trailing end of the toner supply container 5 in terms of the toner-supply-container insertion direction, and to be retracted upward also by the grooves 5h and 5h'. Prior to the mounting of the toner supply container 5 into the apparatus main assembly 100, the second hole 5f3b of the toner outlet hole shutter 5f3 is at the first position, which is 90 degrees apart in terms of the rotational phase of the toner outlet hole shutter 5f3 from the position of the first hole 5f5, and first hole 5f5 is closed by the toner outlet hole shutter 5f3. The shutter holding member 5f2 is provided with a hook 5f2g on which one of a tension spring is hung, and the toner outlet cover 5f1 is kept under the pressure generated by the tension spring in a direction to keep the shutter holding member 5f2 at the first position where the toner outlet cover 5f1 covers the shutter holding member 5f2.

Figures 11A, 11B, 11C:
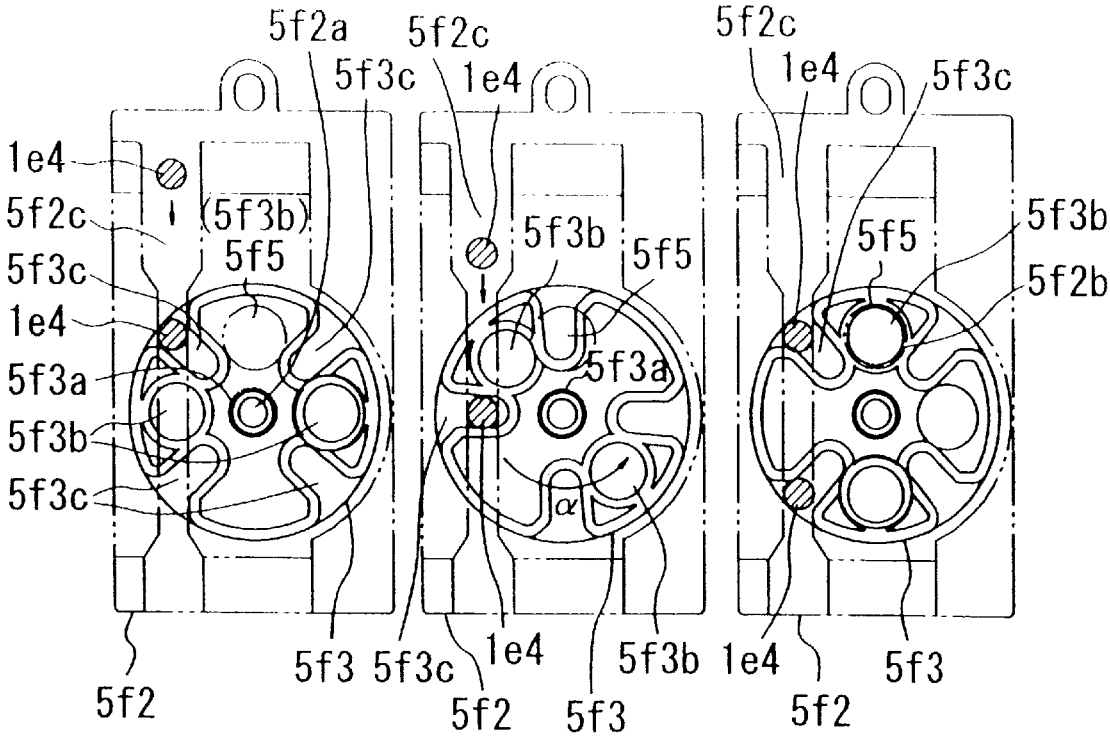
FIGS. 11(*a*) to 11(*f*) show an opening and closing operation of the shutter of the toner supply container.
Figures 11D, 11E, 11F:
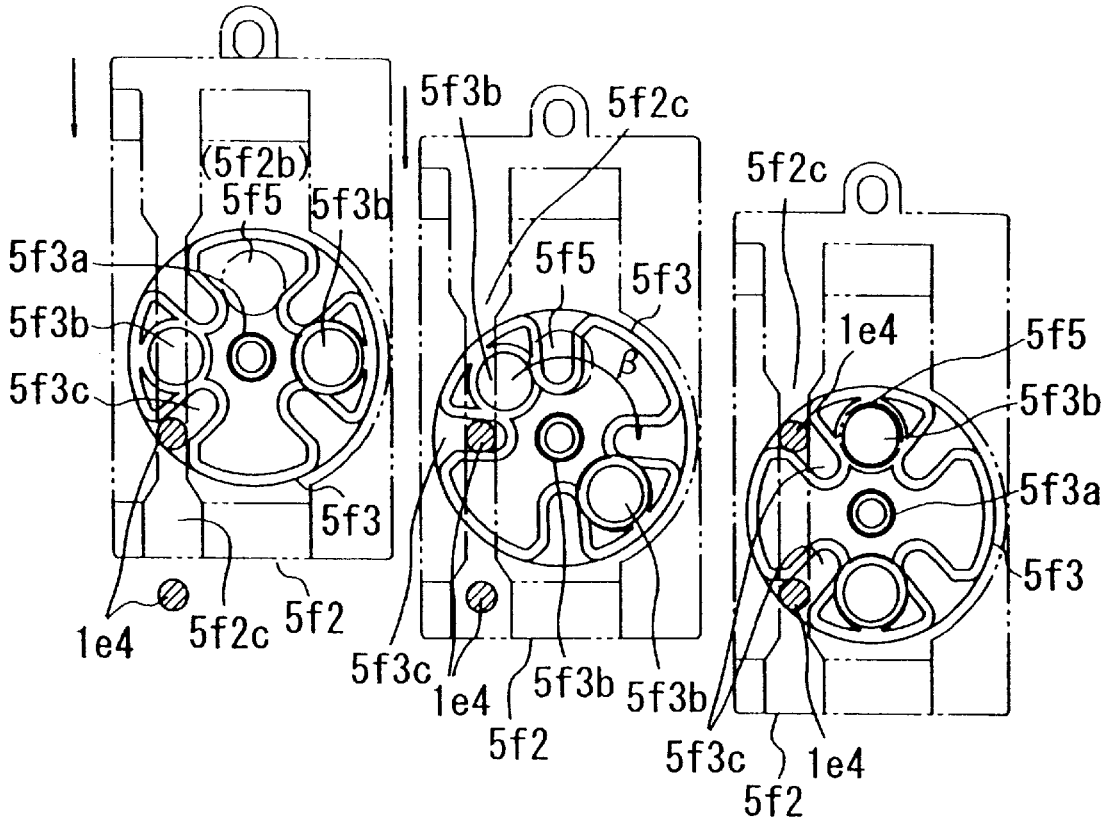

FIG. 11 is a portion enlarged view of an outlet hole 5f of the toner supply container as seen from the bottom side. For better illustration, the pushing member 5f2 is indicated by chain lines with two dots.

As shown in FIG. 11, the outlet hole shutter 5f3 has a center of rotation 5f3a, and is provided with a second opening 5f3b at respective positions which are symmetrical with respect to the center of rotation 5f3a, and with four slits 5f3c at positions 45° away from the second openings 5f3b.

As described in the foregoing, the pushing member 5f2 is provided with a pin 5f2a for rotating the outlet hole shutter 5f3 by engagement with the center of rotation 5f3a of the outlet hole shutter 5f3, the fourth opening 5f2b for toner supply formed in the position in alignment with the first opening 5f5, and a longitudinally extending slit 5f2c.

Before the start of use of the toner supply container 5, the second opening 5f3b of the outlet hole shutter 5f3 takes the first position, which is 90° away from the first opening 5f5 (fourth opening 5f2b), so that first opening 5f5 is closed. The outlet hole cover 5f1 is urged to a position covering the pushing member 5f2, by a shown spring or the like.

A description will be provided as to opening and closing operations of the toner inlet hole shutter, the laser shutter and the toner inlet hole cover provided in the process cartridge 1.

The mounting operation of the process cartridge 1 to the main assembly 100 of the apparatus will first be described.

As shown in FIG. 10(*a*), the main assembly 100 of the apparatus is provided with a pin 67 in an insertion path of the process cartridge 1. When the process cartridge 1 is inserted into the main assembly 100 of the apparatus, the pin 67 passes to the right in the linear slit 1f1 formed in the second pushing member 1f. As shown in FIG. 10(*b*), when the process cartridge 1 is inserted into the main assembly 100 of the apparatus, the pin 67 first abuts the releasing portion 1i2 of the locking member 1i provided on the second pushing member 1f so that engagement between the claw 1i1 of the locking member 1i and the engaging portion 1h6 of the shutter opening and closing cam 1h is released.

Then, the pin 67 is engaged with the cam portion 1h4 formed in the shutter opening and closing cam 1h. With further insertion of the process cartridge 1, the shutter opening and closing cam 1h starts to rotate above the center of rotation 1h3. When it is completely inserted to the mounting position, the shutter opening and closing cam 1h rotates to the second position as shown in FIG. 10(*c*) and in FIG. 18. The above-described inlet hole shutter 1d and the inlet hole cover 1g are interrelated with the rotation of the shutter inlet hole cover 1g and the inlet hole shutter 1d, so that the inlet hole shutter 1d moves in the longitudinal direction (to the left in FIG. 10(*c*)), and the inlet hole cover 1g moves in the orthogonal direction (to the top in FIG. 10(*c*)). By the exposure of the inlet hole 1b1 in this manner, the toner supply into the process cartridge 1 is enabled.

The laser shutter 1k is opened in interrelation with the rotation of the shutter opening and closing cam 1h.

When the process cartridge 1 is taken out of the main assembly 100 of the apparatus, the pin 67 provided in the main assembly 100 of the apparatus is relatively moved to the left, relative to the process cartridge 1 as shown in FIG. 10(*c*). Then, the pin 67 is brought into engagement with the cam portion 1h4 provided in the shutter opening and closing cam 1h to rotate the shutter opening and closing cam 1h in the counterclockwise direction.

As shown in FIG. 10(*b*), in interrelation with the rotation of the shutter opening and closing cam 1h, the inlet hole shutter 1d moves in the longitudinal direction (rightward in FIG. 10(*b*)), and the inlet hole cover 1g moves in the direction perpendicular to the longitudinal direction (downward in FIG. 10(*b*)).

When the shutter opening and closing cam 1h is rotated to the position where the pin 67 and the cam portion 1h4 of the shutter opening and closing cam 1h are disengaged from each other, as shown in FIG. 10(*a*), the inlet hole shutter 1d closes the inlet hole 1b1, and the inlet hole cover 1g closes the opening 1e1. In interrelation with the rotation of the shutter opening and closing cam 1h, the laser shutter 1k is closed, and the exposure opening 1c is closed by the laser shutter 1k. The engaging portion 1h6 of the shutter opening and closing cam 1h is engaged with a claw 1i1 of the locking member 1i provided in the second pushing member 1f to lock rotation of the shutter opening and closing cam 1h.

A description will be provided as to the opening and closing operations of the toner outlet hole shutter 5f3 and the toner outlet hole cover 5f1 provided in the toner supply container 5.

As shown in FIG. 22(*a*), the main assembly 100 of the apparatus is provided with a projection 68 in an insertion path of the toner supply container 5, and when the toner supply container 5 is inserted, the projection 68 abuts the outlet hole cover 5f1 described in the foregoing.

With the further insertion of the toner supply container 5 as shown in FIG. 22(*b*), the outlet hole cover 5*f*1 is led on the rail 5*h* formed in the toner supply container 5, and is moved in the direction away from the toner supply container virtually. When the toner supply container 5 is mounted to the main assembly 100 of the apparatus, the outlet hole 5*f* is opened as shown in FIG. 22(*c*).

FIG. 11 is a drawing for showing the operational stages of the toner outlet hole shutter 5*f*3. FIGS. 11(*a*)–11(*c*) show the stages through which the process cartridge 1 is inserted into the apparatus main assembly 100 in which the toner supply container 5 has already been mounted, whereas FIGS. 11(*d*)–11(*f*) show the stages through which the toner supply container 5 is inserted into the apparatus main assembly 100 in which the process cartridge 1 has already been mounted.

Referring to FIGS. 11(*d*)–11(*f*), when the process cartridge 1 has already been mounted in the apparatus main assembly 100, the two guide pins 1*e*4 are not movable. As the toner supply container 5 is inserted in the direction indicated by an arrow mark in the drawing, the guide pin 1*e*4 of the process cartridge 1 on the front side engages the slit 5*f*3*c* of the toner outlet hole shutter 5*f*3 (FIG. 11(*d*)). In this state, the first hole 5*f*5 is closed by the toner outlet hole shutter 5*f*3, because the position of the second hole 5*f*3*b* is 90 degrees apart from the position of the first hole 5*f*5 (fourth hole 5*f*2*b*) in terms of the rotational phase of the toner outlet hole shutter 5*f*3.

As the toner supply container 5 is further inserted, the toner outlet hole shutter 5*f*3 begins to be rotated in the direction indicated by an arrow mark about the rotational axis 5*f*3*a* (FIG. 11(*e*)). By the time the toner supply container 5 is inserted to its final mounting position, the toner outlet hole shutter 5*f*3 is rotated to the position shown in FIG. 11(*f*), at which the first hole 5*f*5 (fourth hole 5*f*2*b*) of the toner supply container 5 aligns with the second hole 5*f*3*b* of the toner outlet hole shutter 5*f*3, allowing the toner to be discharged.

In comparison, referring to FIGS. 11(*a*) 11(*c*), when the toner supply container 5 has already been mounted in the apparatus main assembly 100, the toner outlet hole shutter 5*f*3 has not rotated, and is rotatable. As the process cartridge 1 is inserted in the direction indicated by an arrow mark in the drawing, the guide pin 1*e*4 of the process cartridge 1, on the leading end of the process cartridge 1 in terms of the process-cartridge insertion direction, engages into the slit 5*f*3*c* of the toner outlet hole shutter 5*f*3 (FIG. 11(*a*)). In this state, the first hole 5*f*5 is closed by the toner outlet hole shutter 5*f*3, since the position of the second hole 5*f*3*b* is 90 degrees apart from the position of the first hole 5*f*5 (fourth hole 5*f*2*b*) in terms of the rotational phase of the toner outlet hole shutter 5*f*3.

As the process cartridge 1 is further inserted, the toner outlet hole shutter 5*f*3 begins to be rotated in the direction indicated by an arrow mark about the rotational axis 5*f*3*a* (FIG. 11(*b*)). By the time the process cartridge 1 is inserted to its final mounting position, the toner outlet hole shutter 5*f*3 is rotated to the position shown in FIG. 11(*c*), at which the first hole 5*f*5 (fourth hole 5*f*2*b*) of the toner supply container 5 aligns with the second hole 5*f*3*b* of the toner outlet hole shutter 5*f*3, allowing the toner to be discharged.

When the process cartridge 1 and the toner supply container 5 are in the state shown in FIGS. 11(*c*) and 11(*f*), the first hole 5*f*5 of the toner supply container 5 and the toner inlet hole 1*b*1 of the process cartridge 1 are in alignment with each other, which is obvious.

Further, the shutter holding member 5*f*2 is attached to the bottom plate 5*i* of the toner supply container 5 in such a manner that it is allowed to make slight vertical movement and/or tilt relative to the bottom plate 5*i*, as described above. Therefore, while the toner supply container 5 or the process cartridge 1 is inserted, the shutter holding member 5*f*2 makes a slight vertical movement and/or tilts to conform to the shape of the sealing member 1*e*3 (FIG. 10) to remain airtightly in contact with the sealing member 1*e*3. Therefore, toner does not scatter outward of the container.

Incidentally, if the toner outlet hole shutter 5*f*3 is the only structural component for preventing toner from leaking from the toner outlet portion 5*f*, it is impossible to completely prevent the toner particles, which have adhered to the wall of the second hole 5*f*3*b* of the toner outlet hole shutter 5*f*3, from leaking. Further, if the toner outlet cover 5*f*1 is the only structural component for preventing the toner leakage, there is a possibility that the toner leakage will occur, since the toner outlet cover 5*f*1 might be moved to its open position due to the operational errors or the like by a user.

However, according to the present invention, the toner supply container 5 is provided with both the toner outlet hole shutter 5*f*3 and the toner outlet cover 5*f*1. In other words, the toner leakage preventing means is given a fail-safe structure. Therefore, the toner particles, which have adhered to the wall of the second hole 5*f*3*b*, do not leak outward since they are prevented by the toner outlet cover 5*f*1 from leaking outward. Further, there is no possibility that the toner outlet portion 5*f* will be exposed due to the operational error or the like, since the slits 5*f*3*c*, that is, the engagement portions, for rotationally driving the toner outlet hole shutter 5*f*3 are covered with the toner outlet cover 5*f*1.

In this embodiment, the inlet hole shutter 1*d* of the process cartridge 1 moves in the longitudinal direction, and the inlet hole cover 1*g* moves in the direction substantially perpendicular to the longitudinal direction. The reason will be described. The inlet hole shutter 1*d* is constructed so as to prevent leakage of the toner by the seal member 1*j*, and therefore, in order to move the inlet hole shutter 1*d*, a force larger than the sliding resistance relative to the seal member 1*j* is required. However, if an attempt is made to move the inlet hole shutter 1*d* in a direction substantially perpendicular to the longitudinal direction, it tends to incline due to the sliding resistance with the seal member 1*j*, with the possible result of unsmooth opening and closing operations.

On the other hand, the inlet hole cover 1*g* is moved in a direction substantially perpendicular to the longitudinal direction, since otherwise it is interferes with the outlet hole 5*f* of the toner supply container 5, or it is contaminated with the toner, since the movement path of the outlet hole 5*f* of the toner supply container 5 is in the longitudinal direction.

Figure 26:
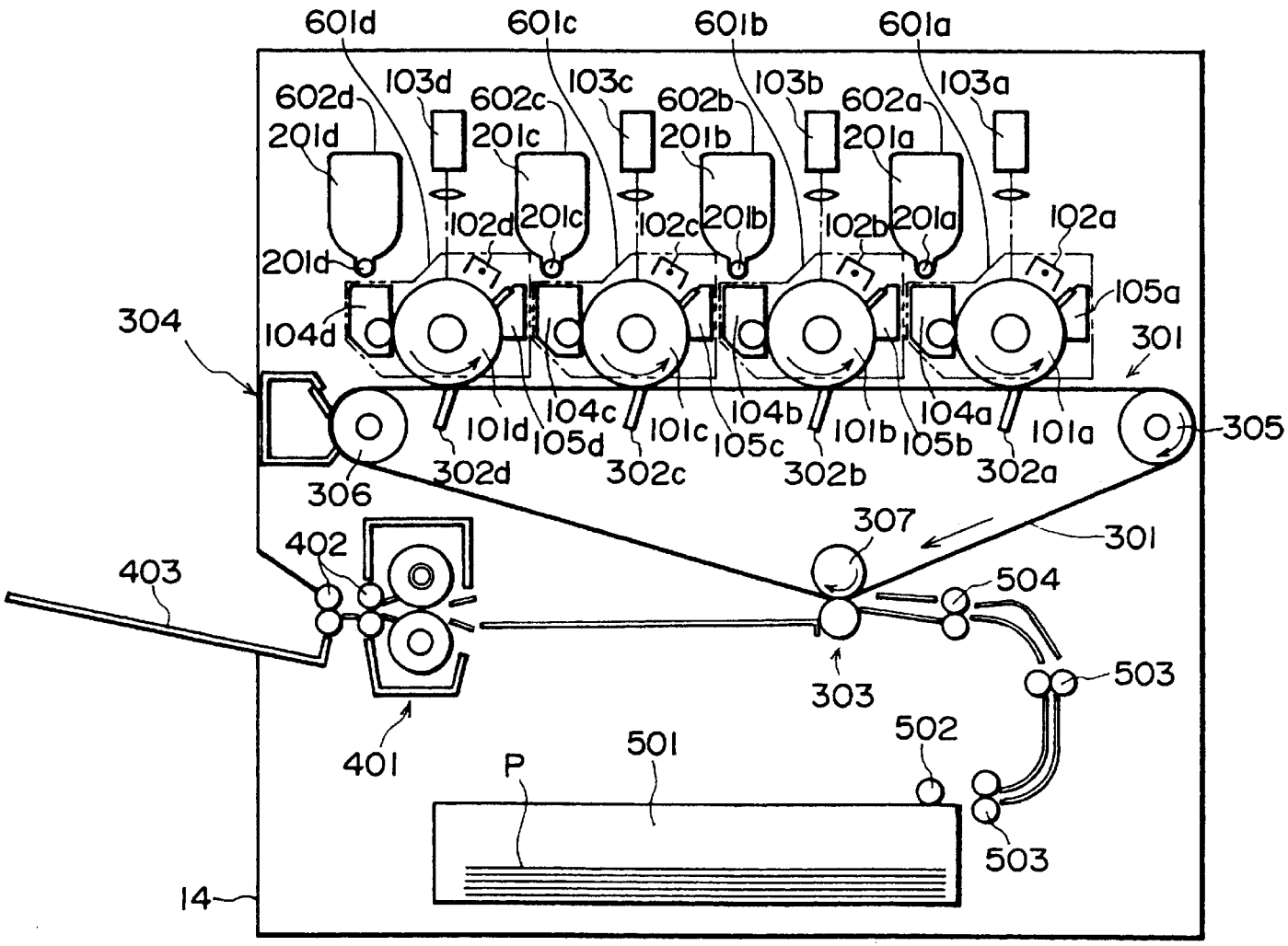
FIG. 26 is a schematic longitudinal sectional view of a color electrophotographic printer according to an embodiment of the present invention.

A description will be provided as to Embodiment 2. FIG. 26 is a schematic sectional view of a color electrophotographic printer as an exemplary image forming apparatus according to this embodiment of the present invention.

The color electrophotographic printer shown in FIG. 26 is provided with a process cartridge 1 (601*a*, 601*b*, 601*c*, 601*d*) independently detachably mountable to the main assembly and a developer container in the form of a cartridge (toner cartridge (602*a*, 602*b*, 602*c*, 602*d*)).

Around the photosensitive drum 101 (image bearing member (101*a*, 101*b*, 101*c*, 101*d*)), there are provided a charging device 102 (102*a*, 102*b*, 102*c*, 102*d*) for uniformly charging a surface of the photosensitive drum 101, an exposure device 103 (103*a*, 103*b*, 103*c*, 103*d*) for projecting image information onto the photosensitive drum 101 with a laser beam, a developing device 104 (104*a*, 104*b*, 104*c*, 104*d*) for visualizing an electrostatic latent image on the photosensitive drum 101, a primary transfer charger 302 (302*a*, 302*b*, 302*c*, 302*d*) for transferring the toner image from the surface of the photosensitive drum 101 onto an intermediary transfer member 301, and a cleaning device 105 (105*a*, 105*b*, 105*c*, 105*d*) for removing and collecting residual toner from the surface of the photosensitive drum 101. There are further provided a secondary transferring device 303 for transferring the toner image transferred onto the intermediary transfer member 301 onto a transfer material P (recording material), an intermediary transfer member cleaning device 304 for removing residual toner from the intermediary transfer member 301, a fixing device 401 for image fixing process, a discharging roller for discharging 402 the transfer material P after the fixing process, and a sheet discharge tray 403 for stacking the transfer material after it is discharged. The intermediary transfer member 301 is made of dielectric film and is extended around a driving roller 305, a follower roller 306 and a secondary transfer opposing roller 307, and the portion thereof stretched between the driving roller 305 and the follower roller 306 contacts the photosensitive drums 101*a*, 101*b*, 101*c*, 101*d*. It is rotated in the direction indicated by the arrow.

The toner cartridge 2 (developer container) comprises a toner accommodating portion 201 (201*a*, 201*b*, 201*c*, 201*d*), which accommodates the toner. When a toner supply signal is produced by toner amount detecting means (unshown) of the developing means, the toner supplying screw rotates to supply the toner.

The transfer materials P (the recording materials) are stacked in a sheet feeding cassette 501 and are fed out seriatim by a sheet feeding roller 502 and are fed by the feeding roller 503 to the registration rollers 504 which feeds the transfer material to the photosensitive drum 101 in synchronism with the toner image. The sheet feeding cassette 501 shown in FIG. 26 has a single stage structure. However, it may have a multistage structure to accommodate different size transfer materials in the same or different orientations so as to facilitate selection of the transfer materials.

The developing device 104 comprises a developing roller, a developing blade, and a feeding screw in a process-cartridge container (developing container, FIG. 29) It. The electrostatic latent image formed on the photosensitive drum 101 is developed by the developing roller. More particularly, the toner in the process cartridge container (developing container) It is applied on the outer periphery of the developing roller 12 in the form of a thin layer, and is electrically charged by a developing blade. When the amount of the toner in the developing container decreases, an unshown sensor detects the event, and the toner is supplied from the toner cartridge 2 into the developing container It through a receiving port 16. The toner fed into the developing container It is fed by the feeding screw 6*a* in a direction perpendicular to the sheet of the drawing of FIG. 29. The opposite end portions of the partition 6*c* between the parallel screws 6*b* provide communicating portions for between the spaces accommodating the screws 6*a*, 6*b*. At one end portion of the partition 6*c*, the toner fed to the end of the other screw 6*b* is fed back by the screw 6*b*, and is returned to the screw 6*a* at the other end of the partition, thus circulating the toner.

The image forming process in the color electrophotographic printer is the same as with a known process, and therefore, a detailed description thereof is omitted for simplicity.

Each of the process cartridges 601*a*, 60*b*, 601*c*, 601*d* contains a photosensitive drum 101*a*, 101*b*, 101*c*, 101*d*, a charging device 102*a*, 102*b*, 102*c*, 102*d*, a developing device 104*a*, 104*b*, 104*c*, 104*d* and a cleaning device 105*a*, 105*b*, 105*c*, 105*d*. Each of the toner cartridges 602*a*, 602*b*, 602*c*, 602*d* contains a toner accommodating portion 201*a*, 201*b*, 201*c*, 201*d*, and a toner supplying screw 202*a*, 202*b*, 202*c*, 202*d*.

Figure 27:
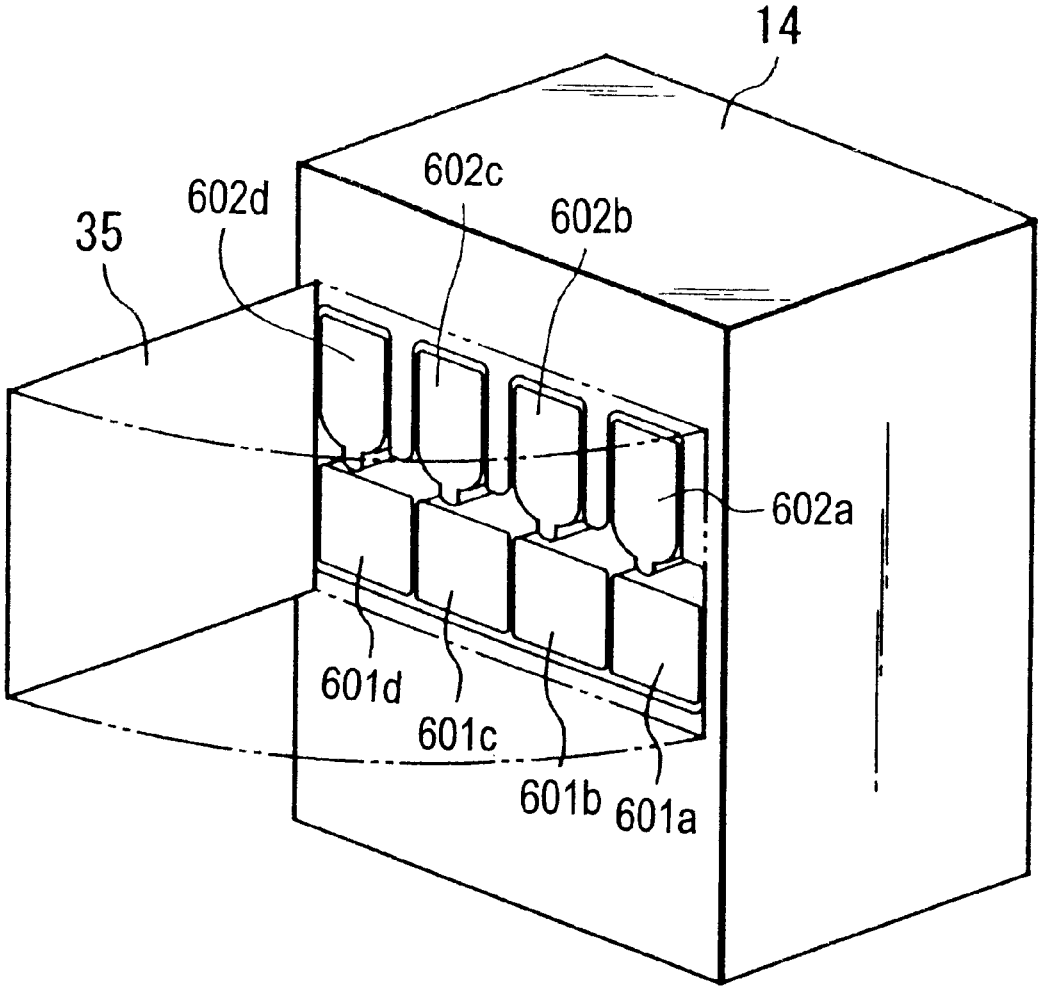
FIG. 27 is a schematic perspective view of a color electrophotographic printer according to an embodiment of the present invention.
Figure 28:
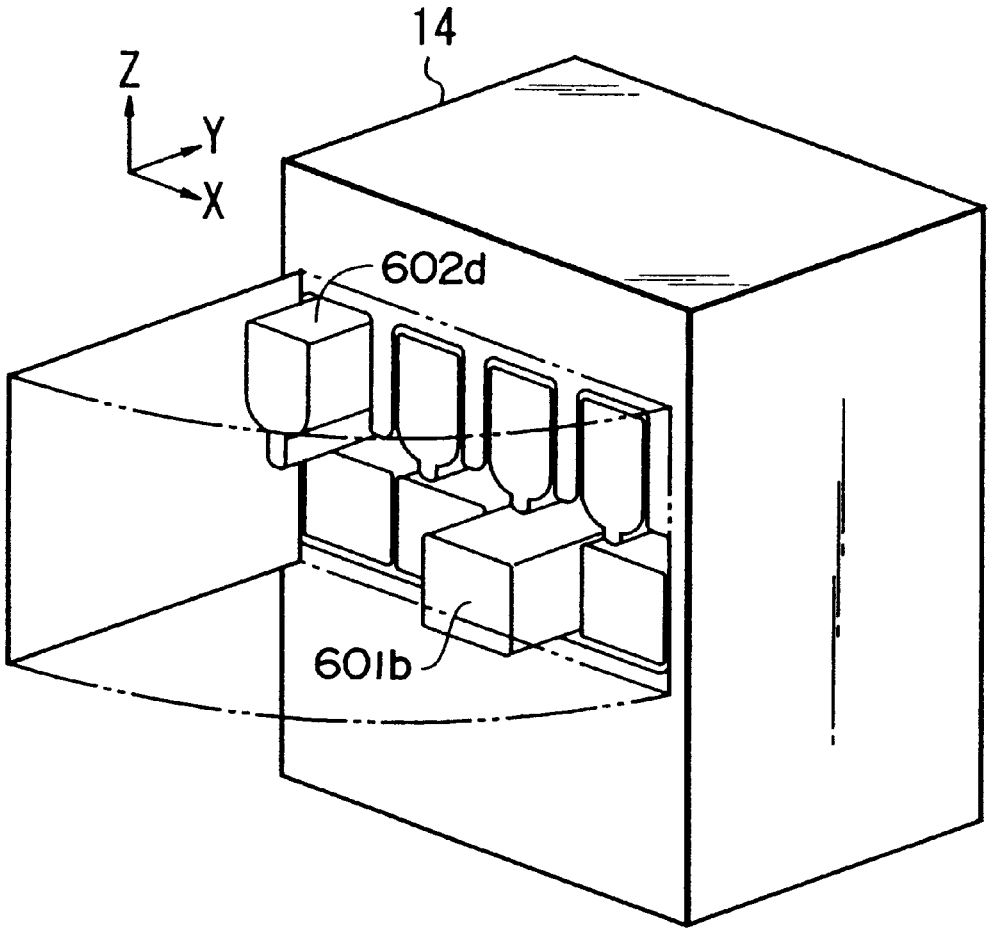
FIG. 28 is a schematic perspective view of a color electrophotographic printer according to an embodiment of the present invention.

FIGS. 27 and 28 are schematic perspective views of the color electrophotographic printer. FIG. 27 illustrates the state in which the front side cover 35 is opening, and FIG. 28 shows a state in which the process cartridge 1 and the toner cartridge 2 are on the way to mounting to the main assembly. The process cartridge 601*a*, 601*b*, 601*c*, 601*d* and the toner cartridge 602*a*, 602*b*, 602*c*, 602*d* are detachably mounted to the main assembly 14 of the color electrophotographic printer along an unshown guiding rail in a direction Y. The photosensitive drum 101 is extended in parallel with the Y direction.

Figure 29:
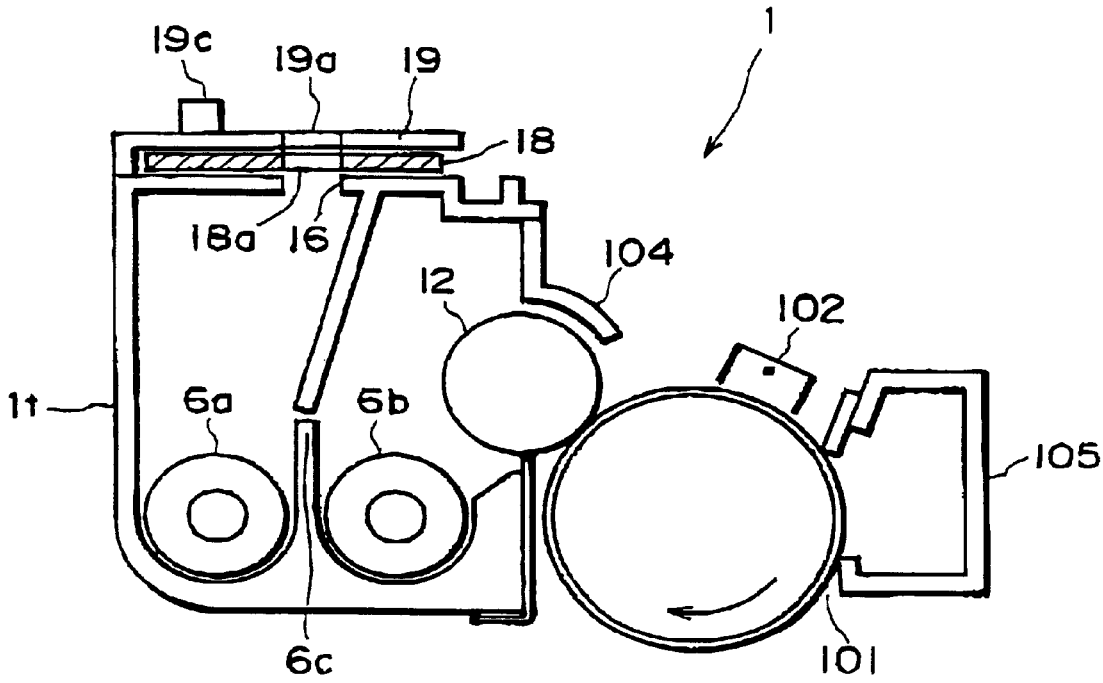
FIG. 29 is a schematic longitudinal sectional view of a neighborhood of a P shutter of a process cartridge according to an embodiment of the present invention.

FIG. 29 illustrates a cross-section of a neighborhood of a shutter of the process cartridge 1 (P shutter) 18. In the state shown in FIG. 29, the communication port 19*a* of the P shutter cover 19 fixed on the process cartridge 1 and the communication port 18*a* of the P shutter 18 are aligned with each other, that is, the toner supply from an unshown toner cartridge is enabled.

Figure 30:
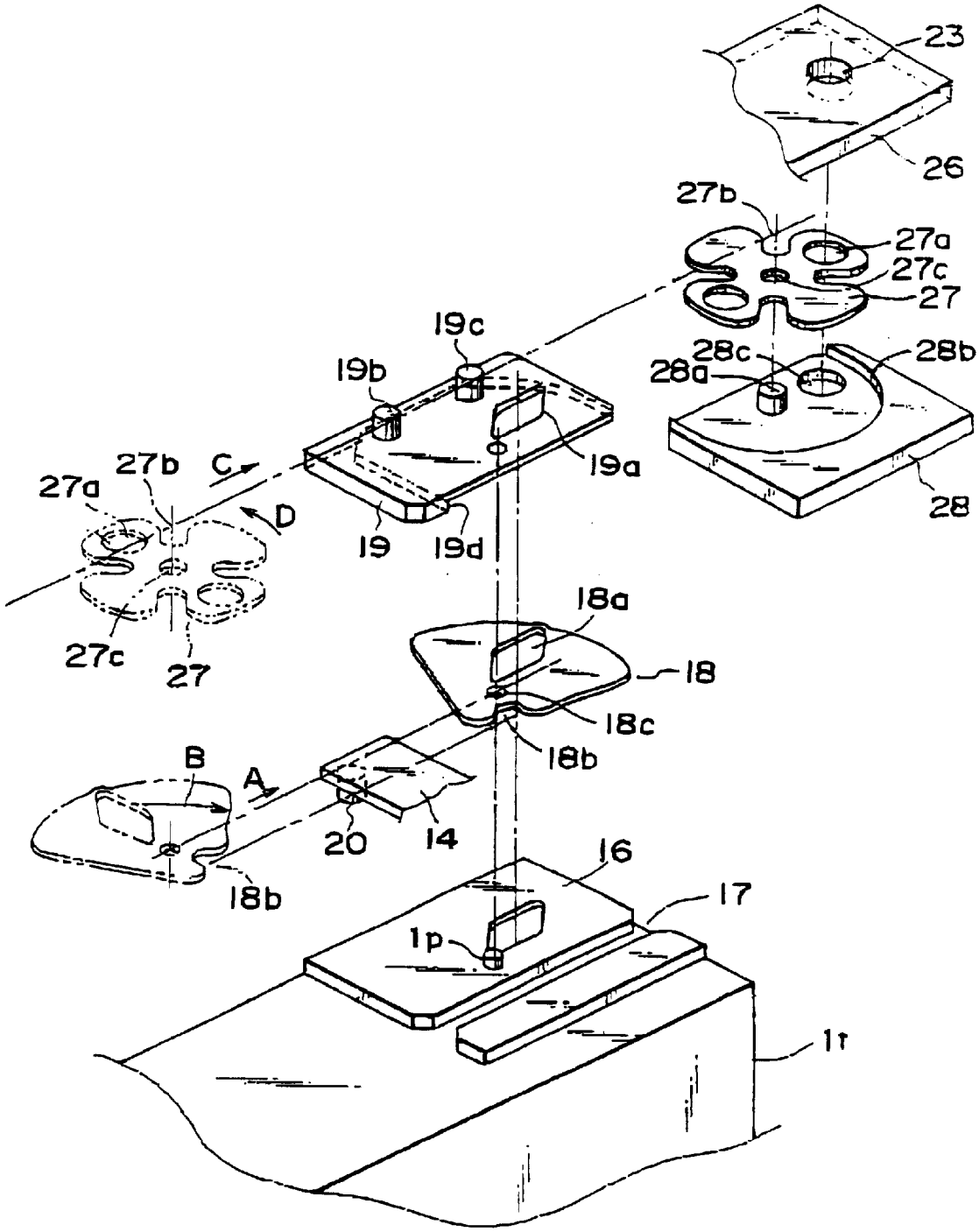
FIG. 30 is a schematic perspective view illustrating a shutter of a process cartridge and an opening and closing operation of a shutter of a toner cartridge according to an embodiment of the present invention.

FIG. 30 is a schematic perspective view of a neighborhood of shutters of the toner cartridge and the process cartridge. A toner receiving port 16 (FIG. 29) is formed in the upper surface of the process cartridge container 1*t*, which is a developing container constituting a frame of the developing device 104 of the process cartridge 1. The toner is supplied from here into the developing device 104. In the toner receiving port 16, there is a center hole 18*c* of the P shutter 18, in which a pin 1*p* provided on the process cartridge container 1*t* adjacent the toner receiving port 16, is rotatably engaged. The P shutter 18 is generally in the form of a sector and is provided with a communication port 18*a*, a U groove 18*b*, and a center hole 18*c*. Outside the P shutter 18, there is provided a P shutter cover 19. The P shutter cover 19 is fixed on the upper surface of the process cartridge container 1*t*, and the P shutter 18 is accommodated in a recess 19*d* formed therein. The U groove 18*b* of the P shutter 18 is outside of the recess 19*d* of the P shutter cover 19. The P shutter cover 19 is provided with a communication port 19*a*, and two cylindrical projections 19*b*, 19*c*. On an extension of a demounting direction (Y direction in FIG. 28) of the U groove 18*b*, there is provided a projection 20 engageable with the U groove 18*b* in the main assembly 14 of the apparatus. On the upper surface of the process cartridge container 1*t*, there is formed a rail 17 to be guided by the projection 20 during the mounting-and-demounting operations of the process cartridge 1. By the rail 17 being guided, the relative positional deviation between the process cartridge 1 and the projection 20 in the lateral direction (X direction in FIG. 28) can be reduced.

On the other hand, at the toner outlet hole 23 of the toner cartridge 2, there is provided a substantially circular shutter (T shutter) 27 which has a center concentric with the center hole 27*c*. The T shutter 27 is provided with groove portion 27*b* at each of quartering positions. Between adjacent groove portions 27*b*, there are openings 27*a*. The openings 27*a* are provided only at two positions diametrically opposite with respect to the center hole 27*c*.

The T shutter 27 of the toner cartridge 2, which is a rotatable shutter, is disposed along the bottom portion 26 of the container of the toner accommodating portion 201 provided in the toner cartridge 2. To the bottom portion 26 of the container, a T shutter supporting member 28 is fixed. The supporting member 28 is provided with a circular recess 28*b* for snug fitting with a part of the T shutter 27. A shaft 28*a* is provided the center of the recess 28*b*. A toner outlet hole 28*c* is provided concentrically with the toner outlet hole 23. The groove portions 27*b* of the T shutter 27 are outside the recess 28*b* while the T shutter 27 is rotating through 90°.

The T shutter 27 is rotatably supported by the engagement between the shaft 28*a* and the center hole 27*c*. When the toner cartridge 2 is inserted into the main assembly 14 of the image forming apparatus (in the direction indicated by an arrow C), the T shutter 27 taking the position indicated by the chain line, disposed at the bottom portion 26 of the container in the toner cartridge 2, is rotated about the shaft 28*a* (in the direction indicated by an arrow D) by engagement between the groove portion 27*b* and the projection 19*b* of the process cartridge 1 into the state indicated by the solid line, thus opening the toner outlet hole 23. The shaft 28*a* is disposed at a front side of the toner outlet hole 23 with respect to the inserting direction of the toner cartridge 2 into the main assembly 14 of the apparatus.

In the foregoing, a description as to a seal member for preventing toner scattering has been omitted. However, urethane foam, felt or the like may be sandwiched between the P shutter 18 and the P shutter cover 19 and/or between the T shutter 27 and the T shutter to improve the sealing performance. The sealing performance may be improved by bonding a seal member on the upper surface of the P shutter cover 19 and on the lower surface of the T shutter supporting member 28.

The T shutter 27 is opened and closed by the relative movement between the process cartridge 1 and the toner cartridge 2 in the mounting-and-demounting direction (direction Y). Thus, both when the process cartridge 1 is in the main assembly 14 of the image forming apparatus, and the toner cartridge 2 is inserted in this state and when the process cartridge 1 is inserted after the toner cartridge 2 is inserted into the main assembly 14 of the image forming apparatus, the groove portion 27*b* of the T shutter 27 is engaged with either one of the projections 19*b*, 19*c* of the P shutter cover 19, so that the opening and closing operation of the T shutter 27 is properly opened and closed. Therefore, if the process cartridge 1 is not mounted to the main assembly 14 of apparatus, the T shutter 27 does not operate, and therefore, the toner outlet hole 23 is kept closed even if the toner cartridge 2 is inserted into the main assembly 14 of the apparatus.

Figure 31:
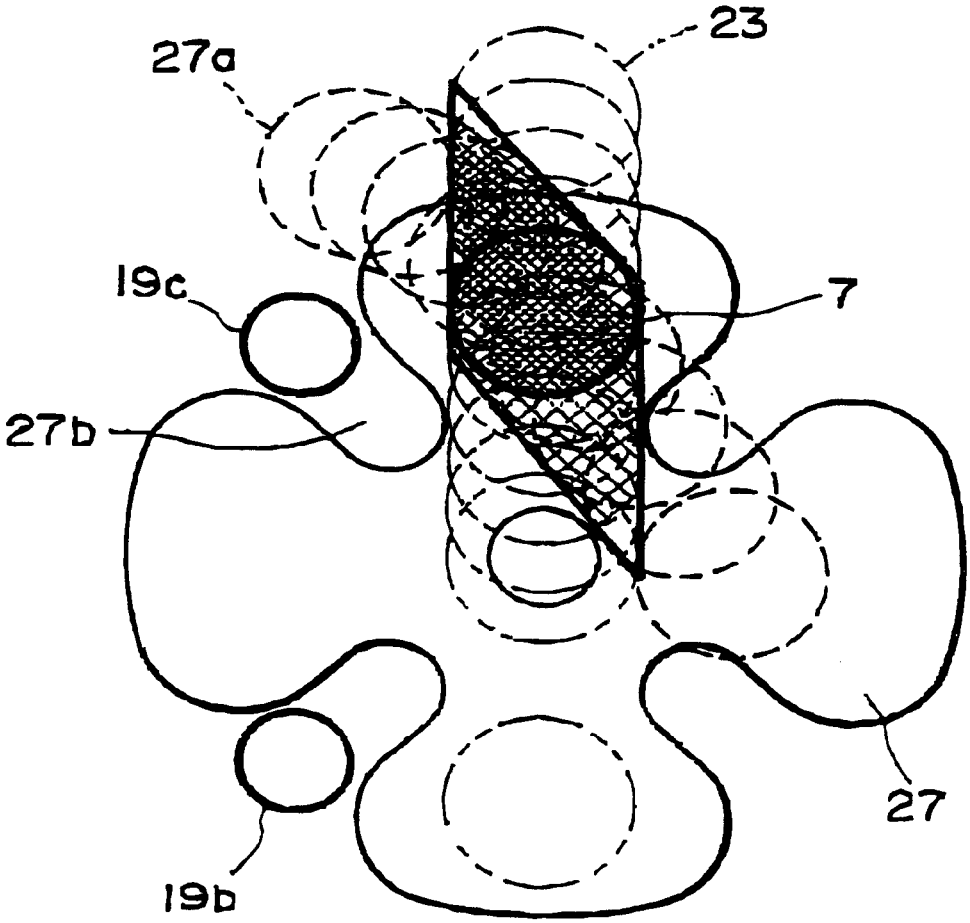
FIG. 31 is a top view illustrating a change of a configuration of a communicating portion according to an embodiment of the present invention.

FIG. 31 shows a change of the configuration of the communicating portion defined by the communication port 18*a* of the P shutter 18 and the opening 27*a* of the T shutter 27 with the rotating operation of the T shutter 27. As described in the foregoing, the T shutter 27 is opened and closed by the relative motion between the process cartridge 1 and the toner cartridge 2 in the inserting and removing the directions. FIG. 31 illustrates the case in which the process cartridge 1 is fixed, and the toner cartridge 2 is moved in the inserting and removing directions. The circles indicated by the chain lines represent a track of the toner outlet hole 23, and circles indicated by broken lines represent a track of the opening 27*a*. The outer shape of the T shutter 27 is indicated only at the position where is overlapped with the toner outlet hole 23. The T shutter 27 is rotated in response to insertion of the toner cartridge 2, and the configuration of the communicating portion defined by the toner outlet hole 23 and the opening 27*a*, is substantially a parallelogram 7 as indicated by the cross-hatching. A pair of sides of the substantially parallelogram 7 is substantially parallel with the inserting and removing directions of the process cartridge 1. Since the toner falls into the region of the substantially parallelogram 7, the sizes of the communication port 19*a* of the P shutter cover 19 and the communication port 18*a* of the P shutter 18 are larger than the substantially parallelogram 7 in order to properly receive the falling toner. If, however, the communication ports 18*a*, 19*a* are too large, the size of the P shutter 18 has to be large so that it cannot be disposed in the upper surface of the process cartridge 1, and in addition, the distance of the movement and the operating force required by the opening and closing operation have to be large. Furthermore, the possibility of the toner scattering increases.

Figure 25:
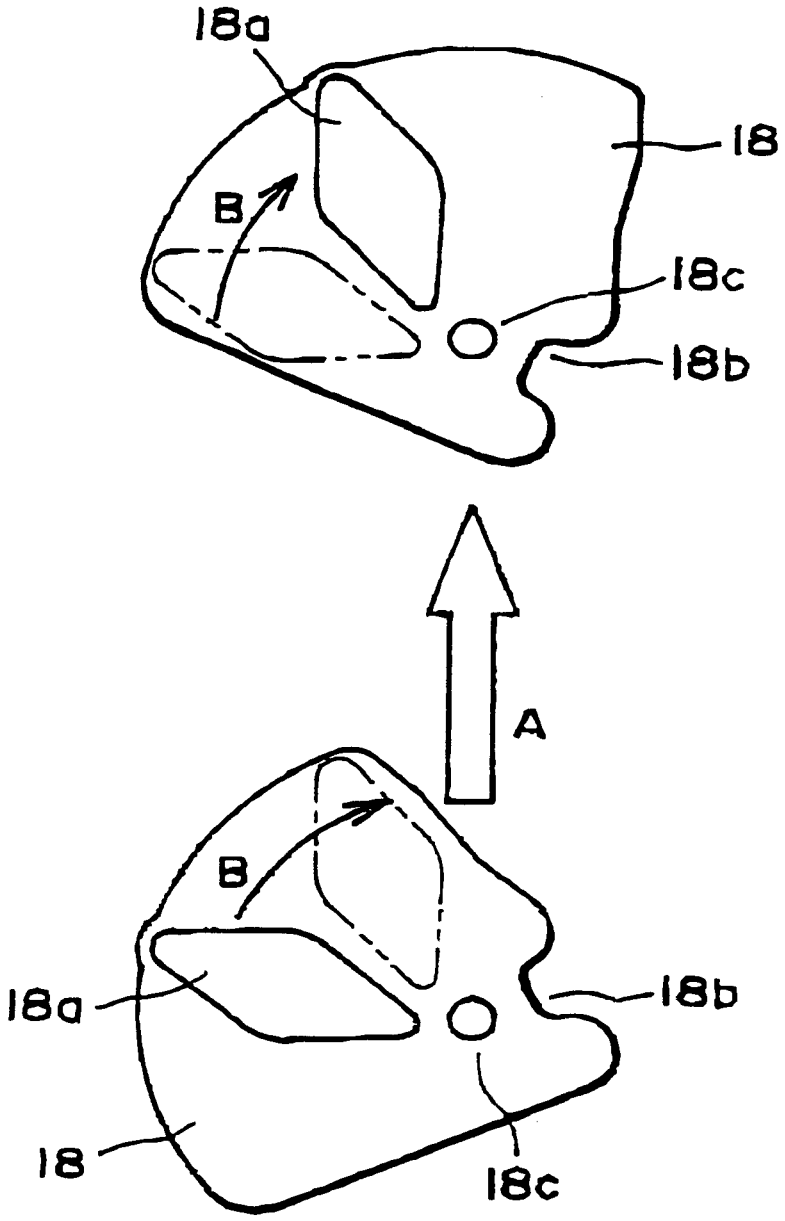
FIG. 25 is a top view of a shutter of a process cartridge according to an embodiment of the present invention.
Figure 32:
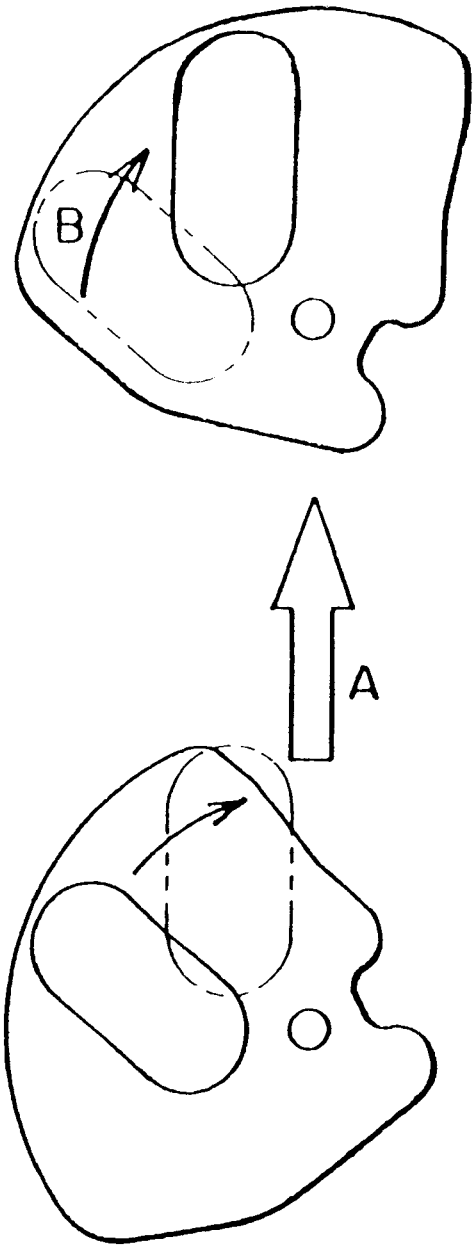
FIG. 32 is a top view of a shutter of a conventional process cartridge.
Figure 33:
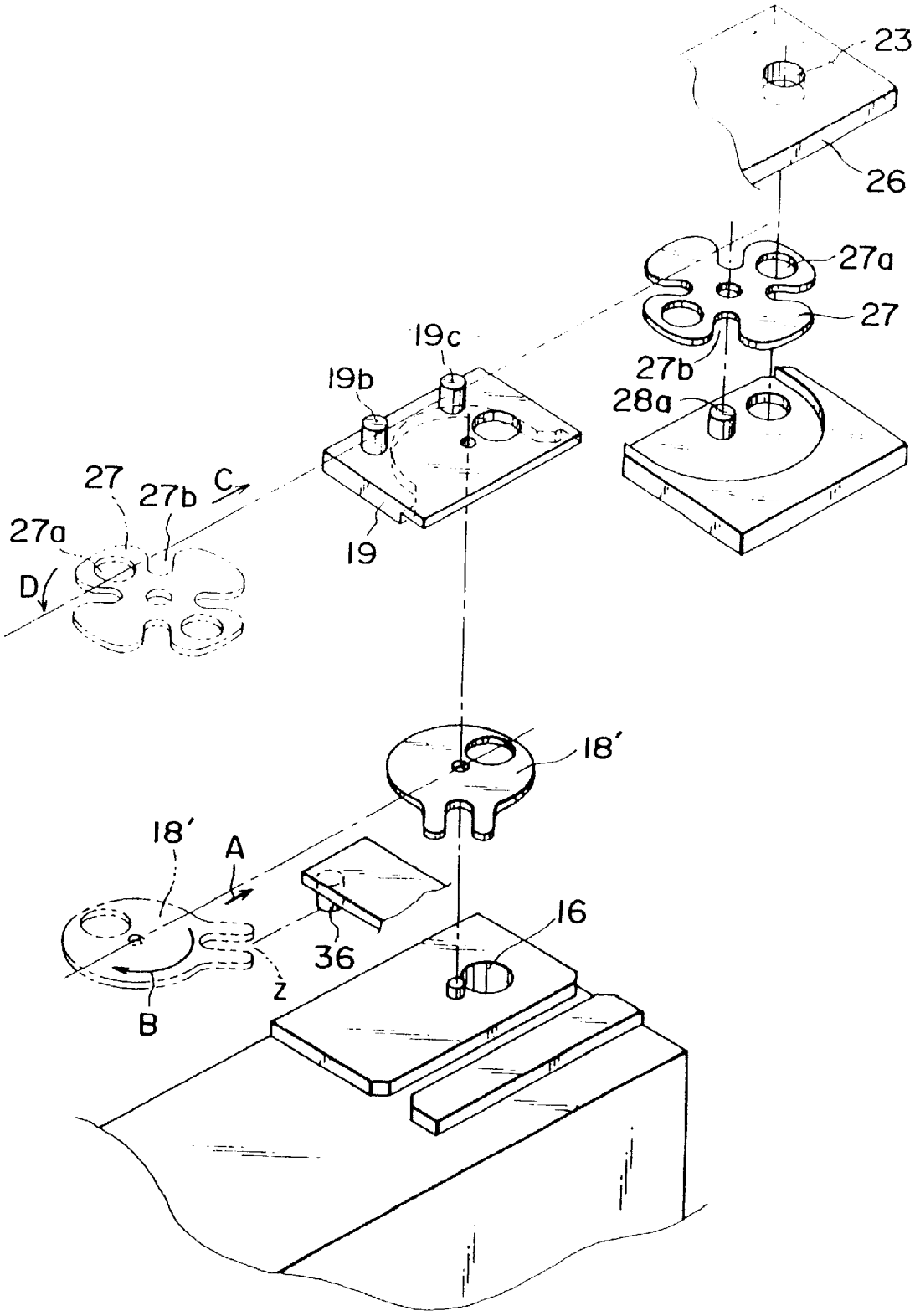
FIG. 33 is a schematic perspective view illustrating a shutter of a conventional process cartridge and an opening and closing operation of a shutter of a toner cartridge.
Figure 34:
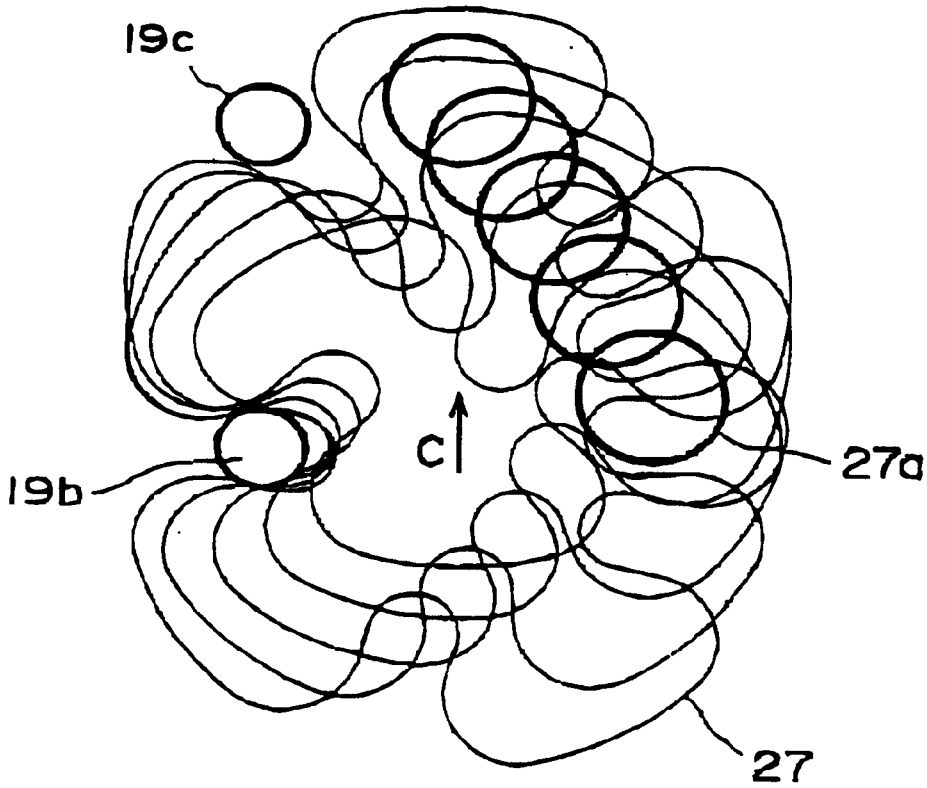
FIG. 34 is a top view showing a track of a shutter of a toner cartridge.

Referring to FIG. 25, a description will be provided as to the P shutter 18 shown in FIG. 30. FIG. 25 is a top plan view of a P shutter disposed on the process cartridge. The inserting direction of the process cartridge 1 is as indicated by an arrow A, that is, upward in the figure. The P shutter 18 shown below the arrow An is in the position of closing the toner receive port 16 (not shown in FIG. 25), and the P shutter 18 shown above the arrow An is in the position of opening it. An edge of the communication port 18*a* is outside the substantially parallelogram 7 by 0.2–1.2 mm More particularly, it is larger by 0.5 mm. The rotation angle of the P shutter 18 for opening and closing the toner receiving port 16 is about 50°. The chain lines indicate open and closed states. In the case that the P shutter 18 has a communication port in the form of an elongated hole 18 as shown in FIG. 32, for example, the "open" and "close" indicated by the chain lines are overlapped with each other, and therefore, the rotation angle 50° as with FIG. 25 is not enough to open and close the shutter.

Because, however, the communication port 18*a* of the P shutter 18 is in the form of a parallelogram, and therefore, the opening and closing is complete by the rotation through 50°, and the region (area) required for the rotation of the P shutter 18 may be small, and provides a larger latitude to the P shutter 18 or another structure. Thus, the rotational range required by the opening and closing of the toner receiving port 16 of the P shutter 18 can be made smaller than 90°. A seal member or the like may be provided between the P shutter 18 and the P shutter cover 19 to improve the sealing property. The smaller rotational angle required for the opening and closing with the use of the sealing, can reduce the possibility of leakage of the toner. The center hole 18*c* of the P shutter 18 in this embodiment, is disposed substantially on an extension of a diagonal line of the communication port 18*a*. Because of this arrangement, the opening and closing is sufficient even with the small rotational angle. The process cartridge and the toner cartridge are insertable and removable independently from each other. As has been described with FIG. 31, the rotational direction of the T shutter may be clockwise or counterclockwise. Since the configuration of the communication port of the P shutter is parallelogram-like, the toner can be received irrespective of the rotational direction of the T shutter.

In the foregoing description, an example has been provided in which there are provided four process cartridges and four toner cartridges. However, this is not limiting, and the present invention is applicable to a monochromatic electrophotographic printer.

In this embodiment, an example has been provided in which the process cartridge contains the electrophotographic photosensitive drum. However, the present invention is applicable to a cartridge containing only a developing device or only a developing device plus a charging device.

While the invention has been described with reference to the structures disclosed herein, it is not confined to the details set forth and this application is intended to cover such modifications or changes as may come within the purpose of the improvements or the scope of the following claims.

What is claimed is:

1. A unit detachably mountable to an image forming apparatus, comprising:

a developer accommodating portion having a developer inlet hole;

a first opening and closing member for opening and closing said inlet hole; and a second opening and closing member for opening and closing said inlet hole, said second opening and closing member being movable above said first opening and closing member, wherein the moving direction of said first opening and closing member and the moving direction of said second opening and closing member are different from each other.

2. A unit according to claim 1, further comprising a cam, operable in response to a mounting or demounting operation of said unit, for moving said first opening and closing member and said second opening and closing member.

3. A unit according to claim 2, further comprising a photosensitive member, an exposure opening for permitting passage of image light to said photosensitive member, and a third opening and closing member for opening and closing said exposure opening, wherein said third opening and closing member is moved in accordance with a movement of said cam.

4. A unit according to claim 1, wherein said first opening and closing member and said second opening and closing member are moved so as to open said inlet hole when said unit is mounted to a main assembly of the image forming apparatus, and said first opening and closing member and said second opening and closing member are moved to close said inlet hole when said unit is removed from the main assembly of the image forming apparatus.

5. A unit according to claim 1, wherein said first opening and closing member is movable in a longitudinal direction of said unit, and said second opening and closing member is movable in a direction substantially perpendicular to the longitudinal direction.

6. An image forming apparatus comprising:

a unit detachably mountable to a main assembly of said apparatus, said unit including a developer accommodating portion having a developer inlet hole and a first opening and closing member for opening and closing said inlet hole, and a second opening and closing member, movable above said first opening and closing member, for opening and closing said inlet hole; and wherein the moving direction of said first opening and closing member and the moving direction of said second opening and closing member are different from each other; and an engaging portion contactable by a predetermined portion of said unit when said unit is mounted to the main assembly of the apparatus, wherein one of said opening and closing members is moved by the contact of the predetermined portion to said engaging portion.

7. An apparatus according to claim 6, wherein said first opening and closing member and said second opening and closing member are moved so as to open said inlet hole when said unit is mounted to the main assembly of the image forming apparatus, and said first opening and closing member and said second opening and closing member are moved to close said inlet hole when said unit is removed from the main assembly of the image forming apparatus.

8. An apparatus according to claim 6, wherein said unit further comprises a photosensitive member, an exposure opening for permitting passage of image light to said photosensitive member, and a third opening and closing member for opening and closing said exposure opening, wherein said third opening and closing member is moved by the contact of the predetermined portion to said engaging portion.

9. A unit detachably mountable to an image forming apparatus, comprising:

a developer accommodating portion having a developer inlet hole; and an opening and closing member for opening and closing said inlet hole;

wherein said inlet hole has a substantially parallelogram shape having an inner angle which is not a right angle.

10. A unit according to claim 9, wherein two sides of said inlet hole are substantially parallel with a longitudinal direction of said unit.

11. An image forming apparatus comprising:

a unit detachably mountable to a main assembly of said apparatus, said unit including a developer accommodating portion having an opening and closing member for opening and closing an inlet hole; and an engaging portion contactable by a predetermined portion of said unit when said unit is mounted to the main assembly of the apparatus, wherein said opening and closing member is moved by the contact of the predetermined portion with said engaging portion;

wherein said inlet hole has a substantially parallelogram shape having an inner angle which is not a right angle.

12. An apparatus according to claim 11, wherein said unit is mounted to the main assembly in a unit mounting direction, and wherein two sides of said inlet hole are substantially parallel with said unit mounting direction.

13. An apparatus according to claim 11, further comprising a developer supply container accommodating a developer to be supplied to said unit, said developer supply container being detachably mountable to the main assembly of said apparatus, wherein said supply container includes a developer outlet hole and a shutter for opening and closing said outlet hole by relative motion between said unit and said shutter.

14. An image forming apparatus comprising:

a first unit detachably mountable to a main assembly of said apparatus, said first unit including a developer outlet hole and a movable shutter having a hole capable of exposing said outlet hole; and a second unit detachably mountable to the main assembly of said apparatus, said second unit having a developer inlet hole for permitting passage of the developer falling from the outlet hole;

wherein said shutter is movable in response to a relative motion between said first unit and said second unit; and wherein a configuration of said inlet hole extends along a track of an overlapped portion of said outlet hole and said hole of said shutter which changes with a mounting or demounting operation of said first or second unit.

* * * * *

UNITED STATES PATENT AND TRADEMARK OFFICE

CERTIFICATE OF CORRECTION

PATENT NO. : 6,564,029 B2
DATED : May 13, 2003
INVENTOR(S) : Hisayoshi Kojima et al.

It is certified that error appears in the above-identified patent and that said Letters Patent is hereby corrected as shown below:

Column 18,
Line 16, “portion ih” should read -- portion 1h1 --.

Column 19,
Line 50, “an” should read -- a --.

Column 29,
Line 65, “parallelogram” should read -- parallelogram shape --.

Column 30,
Lines 3, 5 and 23, “parallelogram” should read -- parallelogram shape --.
Line 23, “1.2mm” should read -- 1.2mm. --.

Signed and Sealed this

Third Day of February, 2004

JON W. DUDAS
*Acting Director of the United States Patent and Trademark Office*